US007620472B2

(12) United States Patent
Hamajima

(10) Patent No.: US 7,620,472 B2
(45) Date of Patent: Nov. 17, 2009

(54) SEWING MACHINE

(75) Inventor: Eiichi Hamajima, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 62 days.

(21) Appl. No.: 11/902,901

(22) Filed: Sep. 26, 2007

(65) Prior Publication Data

US 2008/0078313 A1 Apr. 3, 2008

(30) Foreign Application Priority Data

Sep. 28, 2006 (JP) ..... 2006-265761

(51) Int. Cl.
*G06F 7/66* (2006.01)

(52) U.S. Cl. ..... 700/136; 112/102; 112/272; 112/475.02

(58) Field of Classification Search ..... 700/136, 700/137, 138; 112/102, 272, 470.03, 475.02
See application file for complete search history.

(56) References Cited

U.S. PATENT DOCUMENTS

| | | | | |
|---|---|---|---|---|
| 4,784,071 | A * | 11/1988 | Sadeh et al. | 112/470.07 |
| 4,834,008 | A * | 5/1989 | Sadeh et al. | 112/470.04 |
| 4,860,675 | A * | 8/1989 | Brower et al. | 112/119 |
| 5,271,345 | A * | 12/1993 | Matschulat et al. | 112/470.07 |
| 6,450,110 | B1 | 9/2002 | Brühl et al. | |
| 6,470,813 | B2 * | 10/2002 | Ebata et al. | 112/102.5 |
| 6,871,606 | B2 | 3/2005 | Schweizer | |
| 6,883,446 | B2 | 4/2005 | Koerner | |
| 6,959,657 | B1 * | 11/2005 | Duval | 112/475.02 |
| 6,994,042 | B2 * | 2/2006 | Schweizer | 112/470.03 |
| 2003/0131773 | A1 * | 7/2003 | Schweizer | 112/102.5 |
| 2005/0016428 | A1 * | 1/2005 | Koerner | 112/117 |
| 2006/0015209 | A1 * | 1/2006 | Schweizer | 700/136 |
| 2006/0213415 | A1 * | 9/2006 | Konig et al. | 112/475.01 |
| 2007/0272136 | A1 | 11/2007 | Shimizu | |

FOREIGN PATENT DOCUMENTS

| | | |
|---|---|---|
| JP | A-59-088194 | 5/1984 |
| JP | A-59-088196 | 5/1984 |
| JP | A-59-230593 | 12/1984 |
| JP | B2 2850519 | 11/1998 |
| JP | A 2001-353389 | 12/2001 |
| JP | A 2002-292175 | 10/2002 |
| JP | A 2006-517449 | 7/2006 |
| JP | A-2007-313159 | 12/2007 |

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

A sewing machine executing a free-motion capable of sewing while a workpiece cloth is manually moved by an operator includes a needlebar having a lower end to which a sewing needle is attached, a needlebar driving mechanism vertically driving the needlebar via a main shaft, a presser foot pressing the workpiece cloth manually moved by the operator, an imaging device imaging at least an area of the workpiece cloth near to the sewing needle, a movement amount operating device obtaining by operation a movement amount of the workpiece cloth based on image data from the imaging device, a setting device setting a stitch pitch on the workpiece cloth, a comparing device comparing the obtained movement amount of the workpiece cloth and the set stitch pitch, a cloth movement limiter limiting movement of the workpiece cloth by the manual operation, and a control device controlling the cloth movement limiter according to a result of comparison.

8 Claims, 19 Drawing Sheets

| PRESSING FORCE P [N] | REFERENCE DRIVE STEP NUMBER (CLOTH PRESSURE 0 mm) |
|---|---|
| 0 | INITIAL VALUE A |
| 0.5 | A+α |
| 1.0 | A+2α |
| 1.5 | A+3α |
| 2.0 | A+4α |
| 2.5 | A+5α |
| 3.0 | A+6α |
| 3.5 | A+7α |
| ⋮ | ⋮ |
| 20 | A+40α |

FIG. 12

| REFERENCE DRIVE STEP NUMBERS WHEN PRESSING FORCE P=0 [N] | CLOTH PRESSURE (mm) |
|---|---|
| A | 0 |
| A-b | 1 |
| A-2b | 2 |
| A-3b | 3 |

FIG. 13

| MOVEMENT AMOUNT DIFFERENCE ( Δ D mm) | CHANGED PRESSING FORCE ( Δ P) |
|---|---|
| $2.0 \leqq \Delta D$ | +2.0 |
| $1.5 \leqq \Delta D < 2.0$ | +1.5 |
| $1.0 \leqq \Delta D < 1.5$ | +1.0 |
| $0.5 \leqq \Delta D < 1.0$ | +0.5 |
| $-0.5 \leqq \Delta D < 0.5$ | 0 |
| $-1.0 \leqq \Delta D < -0.5$ | -0.5 |
| $-1.5 \leqq \Delta D < -1.0$ | -1.0 |
| $-2.0 \leqq \Delta D < -1.5$ | -1.5 |
| $\Delta D < -2.0$ | -2.0 |

FIG. 14

SEWING MACHINE

CROSS-REFERENCE TO RELATED APPLICATIONS

This application is based upon and claims the benefit of priority from the prior Japanese Patent Application No. 2006-265761 filed on Sep. 28, 2006, the entire contents of which are incorporated herein by reference.

BACKGROUND

1. Technical Field

The present disclosure relates to a sewing machine comprising a sewing mechanism including a needlebar with a lower end to which a sewing needle is attached, a needle thread take-up and a thread seizing hook, and a cloth pressing mechanism including a presser foot pressing workpiece cloth, the sewing machine being capable of free-motion sewing while the workpiece cloth being manually fed.

2. Description of the Related Art

Conventional household sewing machines can carry out a normal sewing in which a feed dog mounted on a sewing bed is moved back and forth so that sewing is carried out while the workpiece cloth is fed. In addition to the normal sewing, the household sewing machines are constructed and arranged so as to be capable of free-motion quilting in which the feed dog is retracted inside the bed and sewing is carried out which an operator manually moves workpiece cloth freely. When quilting is to be carried out in a free-motion manner, a presser bar to which a presser foot is attached is moved upward so that the presser foot is held at a position spaced away from workpiece cloth by a predetermined short distance, whereby the workpiece cloth placed on the upper surface of the bed is manually movable freely.

For example, JP-A-2002-292175 discloses a sewing machine including a sewing arm provided with a needlebar with a lower end to which a sewing needle is attached, a needlebar driving mechanism vertically driving the needlebar, an image sensor loading, as a still image, a part of image taken from workpiece cloth, and the like. Thus constructed sewing machine is arranged so that a microcomputer measures at intervals of predetermined time a distance by which the workpiece cloth is fed and so that an operating speed of the needlebar is changed according to the measured distance. More specifically, the vertical movement of the needlebar is slowed down when the distance by which the workpiece cloth is fed is short, whereas the vertical movement of the needlebar is speeded up. As a result, stitches are formed at a set pitch even when workpiece cloth is fed by manual operation.

In the above-described sewing machine, however, the vertical movement speed of the needlebar, that is, when stitches are formed while the operator manually moves the workpiece cloth a rotational speed of a sewing machine motor is rapidly changed according to the distance by which the workpiece cloth is fed. Consequently, a beginner unfamiliar with sewing is forced to carry out quilting by feeding the workpiece cloth while having anxiety. Thus, there is a problem that the operator cannot sufficiently enjoy quilting.

SUMMARY

Therefore, an object of the disclosure is to provide a sewing machine which can carry out sewing at a set stitch pitch when quilting is executed in a free motion manner and with which even a beginner unfamiliar with sewing can carry out quilting while enjoying the quilting without any anxiety.

The present disclosure provides a sewing machine which is capable of executing a free-motion sewing while a feed dog is accommodated in a bed and a workpiece cloth to be sewn is manually moved by an operator, comprising a sewing machine motor, a main shaft driven by the sewing machine motor, a needlebar having a lower end to which a sewing needle is attached, a needlebar driving mechanism that vertically drives the needlebar via the main shaft, a presser foot that presses the workpiece cloth manually moved by the operator, an imaging device that images at least an area of the workpiece cloth near to the sewing needle, a movement amount operating device that obtains by operation a movement amount of the workpiece cloth based on image data supplied from the imaging device, a setting device that sets a stitch pitch on the workpiece cloth, a comparing device that compares the movement amount of the workpiece cloth obtained by the movement amount operating device and the stitch pitch set by the setting device, a cloth movement limiter that limits movement of the workpiece cloth by the manual operation, and a control device that controls the cloth movement limiter according to a result of comparison by the comparing device.

According to the above-described construction, the workpiece cloth is manually moved by the operator. In this case, a movement amount of the workpiece cloth is imaged by the imaging device every sewing cycle without change in a rotational speed of the sewing machine motor. A movement amount of the workpiece cloth manually moved by the operator is obtained by operation based on the data of image imaged by the imaging device. The obtained movement amount and the stitch pitch are compared. The movement of the workpiece cloth is controlled according to the result of comparison. Consequently, since the movement amount of the workpiece cloth can be limited so as to be substantially equal to the stitch pitch, even a beginner unfamiliar with sewing can carry out free-motion sewing such as quilting without anxiety while enjoying.

BRIEF DESCRIPTION OF THE DRAWINGS

Other objects, features and advantages of the present disclosure will become clear upon reviewing the following description of the illustrative examples with reference to the accompanying drawings, in which:

FIG. 12 shows set data of a step-number table;

FIG. 13 shows set data of a thick-cloth table;

FIG. 14 shows set data of a pressing force changing table;

DETAILED DESCRIPTION OF THE DISCLOSURE

Figure 1:
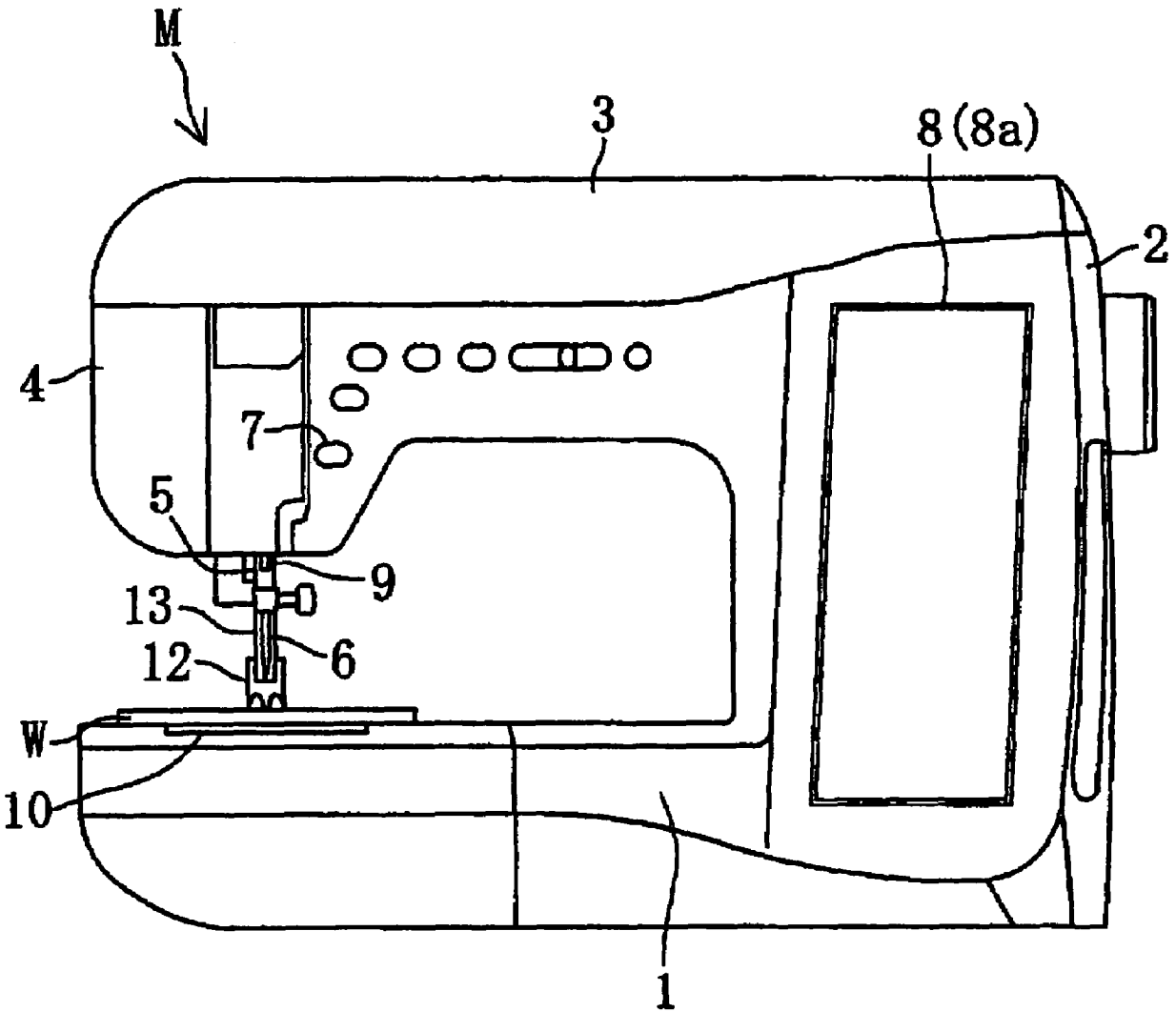
FIG. 1 is a front view of a lockstitch sewing machine of a first illustrative example of the present disclosure.

A first illustrative example of the present disclosure will be described with reference to FIGS. 1 to 20. Referring to FIG. 1, a lockstitch sewing machine M is capable of embroidering when a separate embroidery device (not shown) is attached thereto. The lockstitch sewing machine M includes a sewing bed 1 having a free-arm portion (not shown) to which the embroidery device is detachably attached. The lockstitch sewing machine M further includes a pillar 2 standing on a right end of the bed 1 and a sewing arm 3 extending leftward from an upper end of the pillar 2 so that the sewing arm is opposed to the bed 1. The bed 1 is provided with a cloth feeding mechanism including a feed dog vertically moving mechanism (not shown) moving a feed dog (not shown) vertically and a feed dog back-and-forth moving mechanism (not shown) moving the feed dog back and forth. The bed 1 is further provided with a thread loop taker (a horizontally rotating shuttle, for example; and not shown) accommodating a thread bobbin (not shown) and cooperating with a sewing needle 6 and a thread cutting mechanism (not shown) cutting needle and bobbin threads, and the like.

The arm 3 has a front on which a start/stop switch 7 is mounted for instructing start and stop of sewing. The pillar 2 has a front on which a color liquid crystal display 6 is mounted. The liquid crystal display 8 displays stitch patterns of various ordinary patterns, various function names, pattern names, various messages and the like. A touch key 8*a* (see FIG. 11) comprised of a transparent electrode is mounted on the front of the liquid crystal display 8. The touch key 8*a* is suitably operated by an operator so that a pattern to be sewn and various parameters can be set.

A color image sensor 9 is mounted on the underside of the head 4 so as to be located in front of the needlebar 5 and so as to be directed downward. The image sensor 9 is adapted to image workpiece cloth W substantially from above. The workpiece cloth W is placed on an upper face of a needle plate 10 of the bed 1. The image sensor 9 comprises a charge coupled device (CCD) image pickup device. In this arrangement, when workpiece cloth W to be sewn is placed on the upper face of the bed 1, a part of the workpiece cloth W near to the sewing needle 6 is adapted to be imaged by the image sensor 9 within a substantially circular image area.

Figure 2:
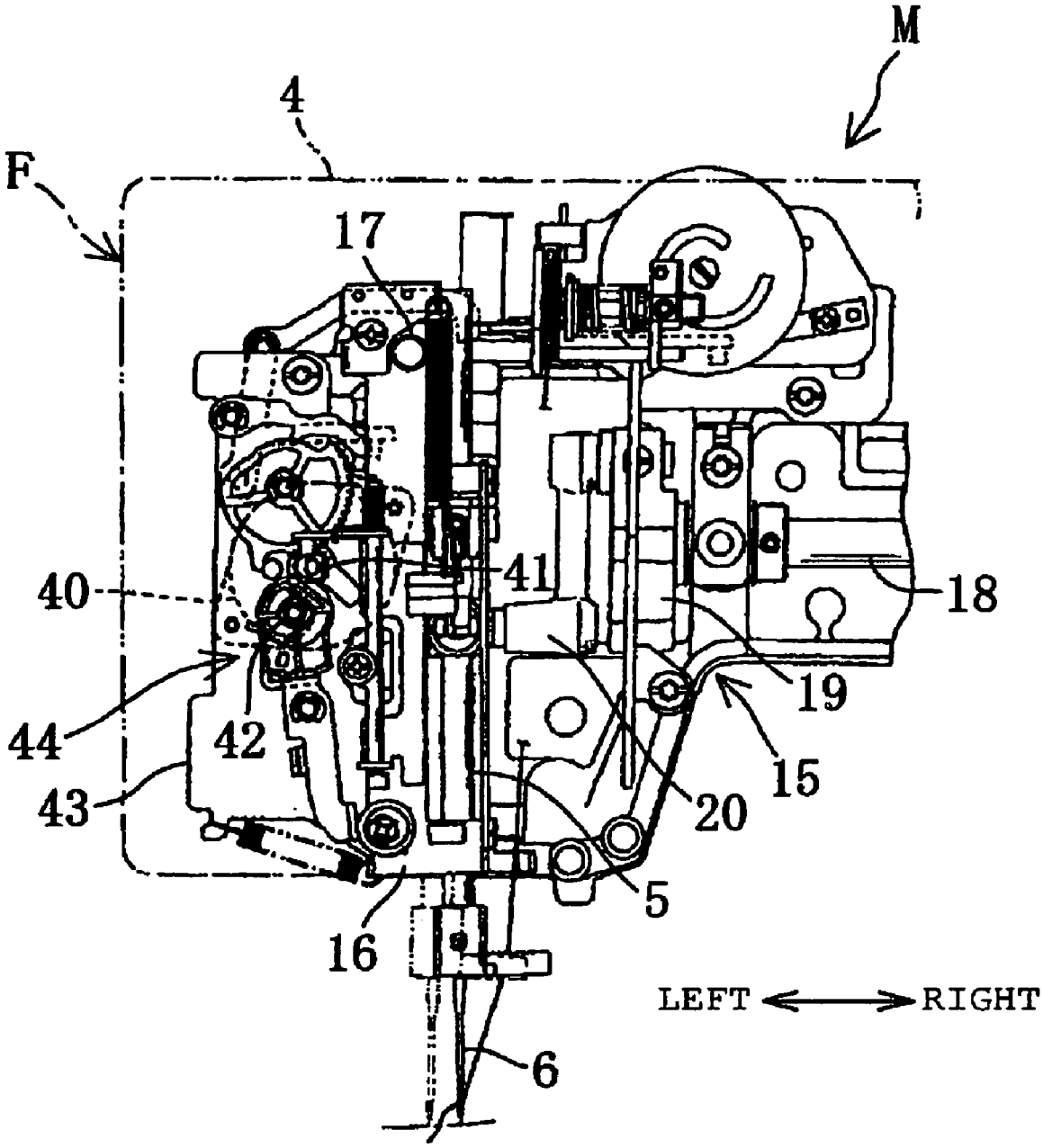
FIG. 2 is a partially front view of the head of the lockstitch sewing machine.

Referring to FIG. 2, the head 4 of the lockstitch sewing machine M is provided with a needlebar driving mechanism 15 vertically driving the needlebar 5 and a needlebar swinging mechanism which drives a first cam member 44 by a drive motor 40 to swing the needlebar 5 right and left. The cam member 44 is formed with an eccentric swinging cam 44*a* (see FIG. 5). The head 4 is further provided with a needlebar releasing mechanism 30 (see FIG. 3) and a thread tensioning mechanism (not shown) applying tension to a needle thread in a needle thread passage extending from a thread spool (not shown) to the sewing needle 6 attached to the lower end of the needlebar 5. The head 4 is still further provided with a pressing force adjusting mechanism 14 (see FIG. 6) adjusting a pressing force by which a presser foot 12 attached to a lower end of the presser bar 13 presses the workpiece cloth W, and a pressing force adjusting motor 52 driving the pressing force adjusting mechanism 14. In the above-described construction, the needlebar swinging mechanism and the needlebar releasing mechanism 30 are driven by a common drive motor 40.

Figure 3:
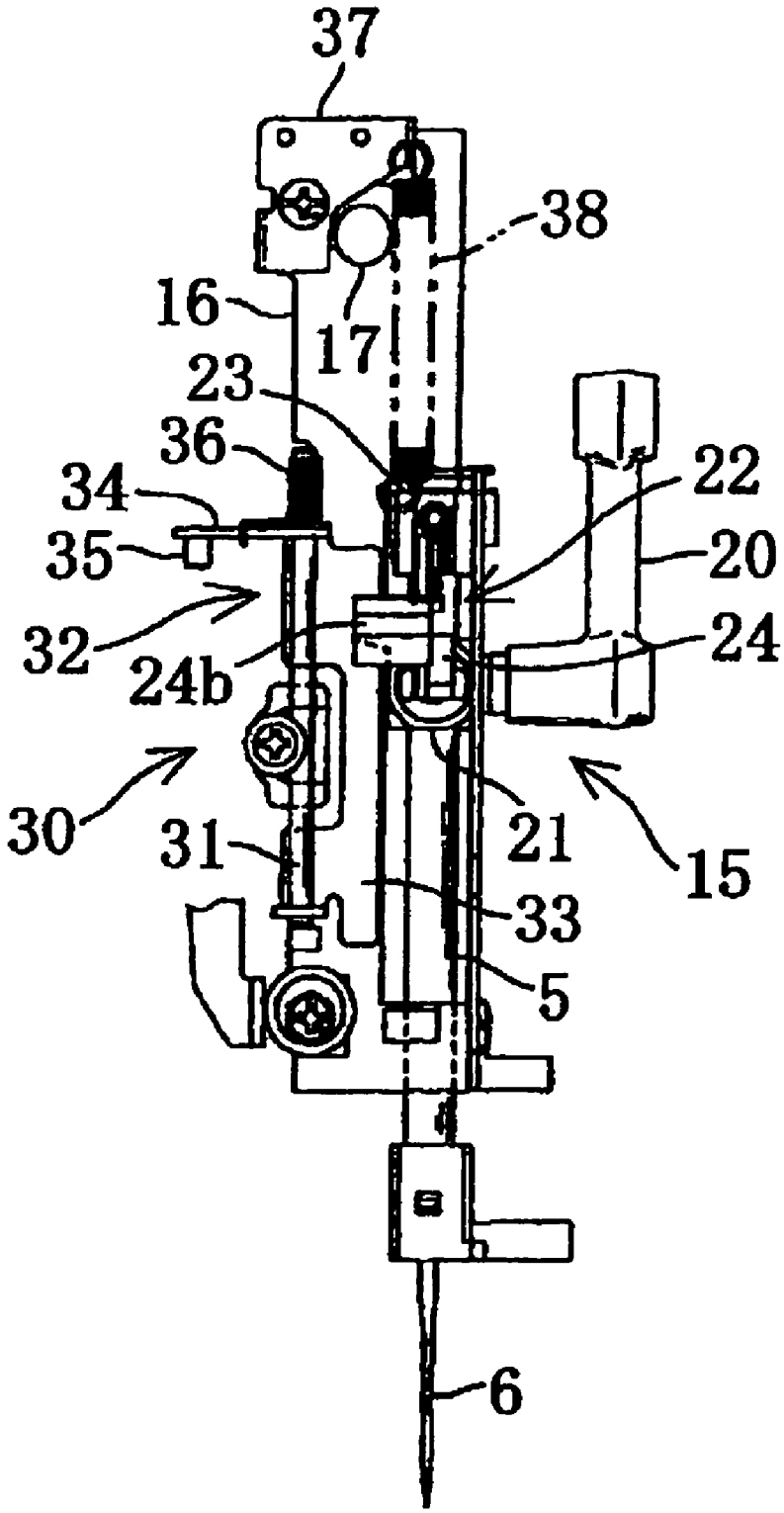
FIG. 3 is a partially front view of a needlebar driving mechanism and a needlebar releasing mechanism.
Figure 4:
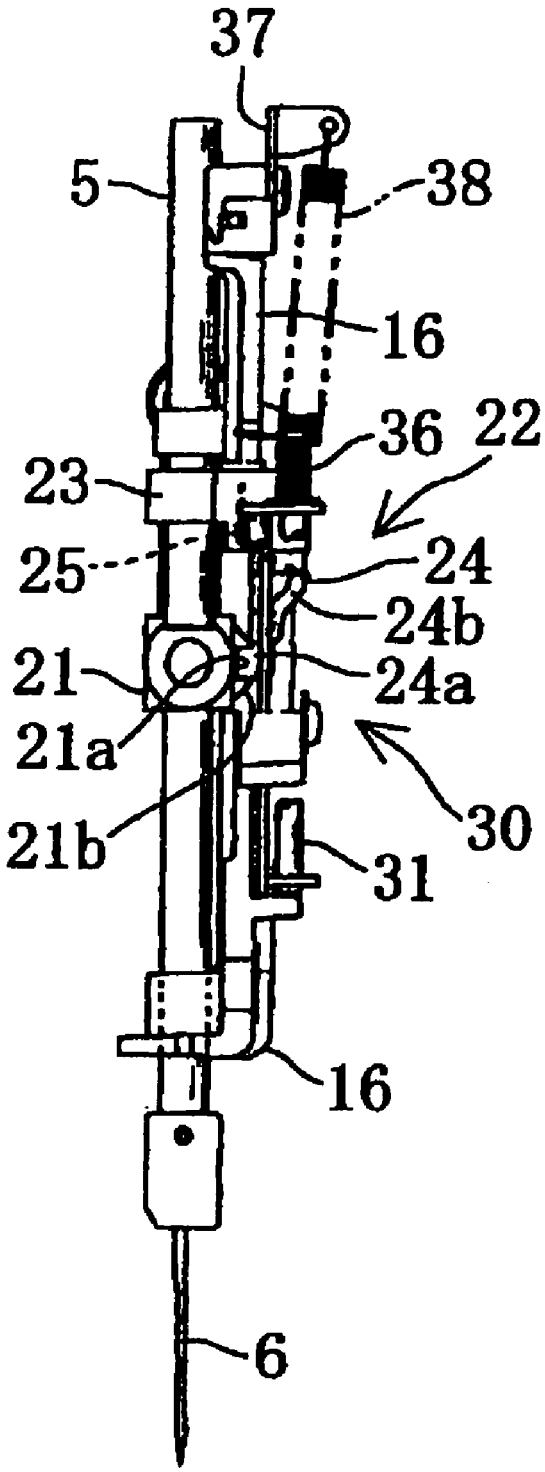
FIG. 4 is a partially side view of the needlebar driving mechanism and a needlebar releasing mechanism.
Figure 5:
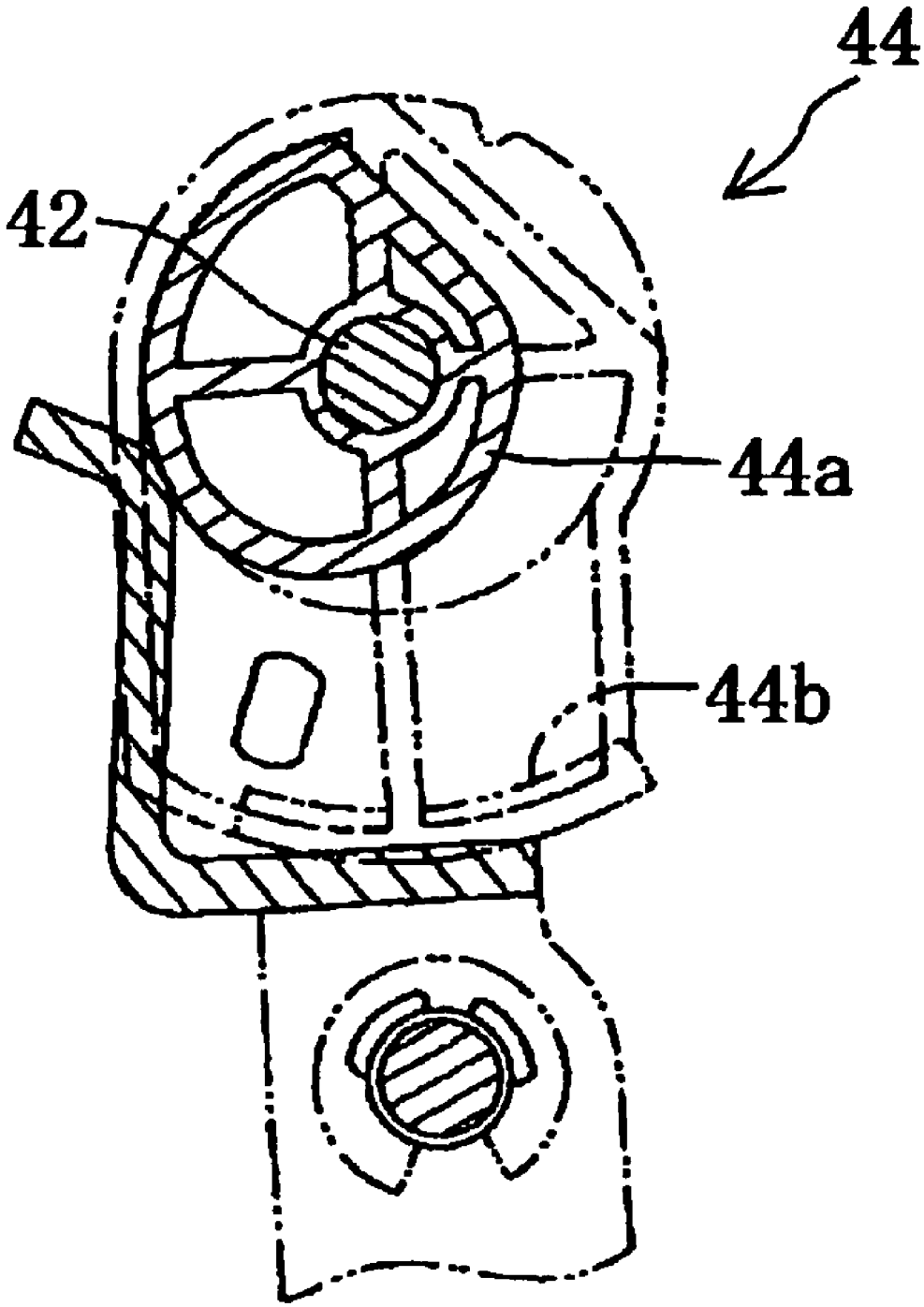
FIG. 5 is a longitudinally sectional front view of a first cam member.

The needlebar driving mechanism 15 will firstly be described with reference to FIGS. 2 to 4. A needlebar support 16 is disposed substantially in the center of the sewing machine head 4 so as to be directed vertically. The needlebar support 16 has an upper end which is mounted to a frame F by a pivot pin 17 so as to be swingable. The needlebar 5 is supported on the needlebar support 16 so as to be vertically movable. The needlebar 5 has a lower end to which the sewing needle 6 is detachably attached.

Figure 11:
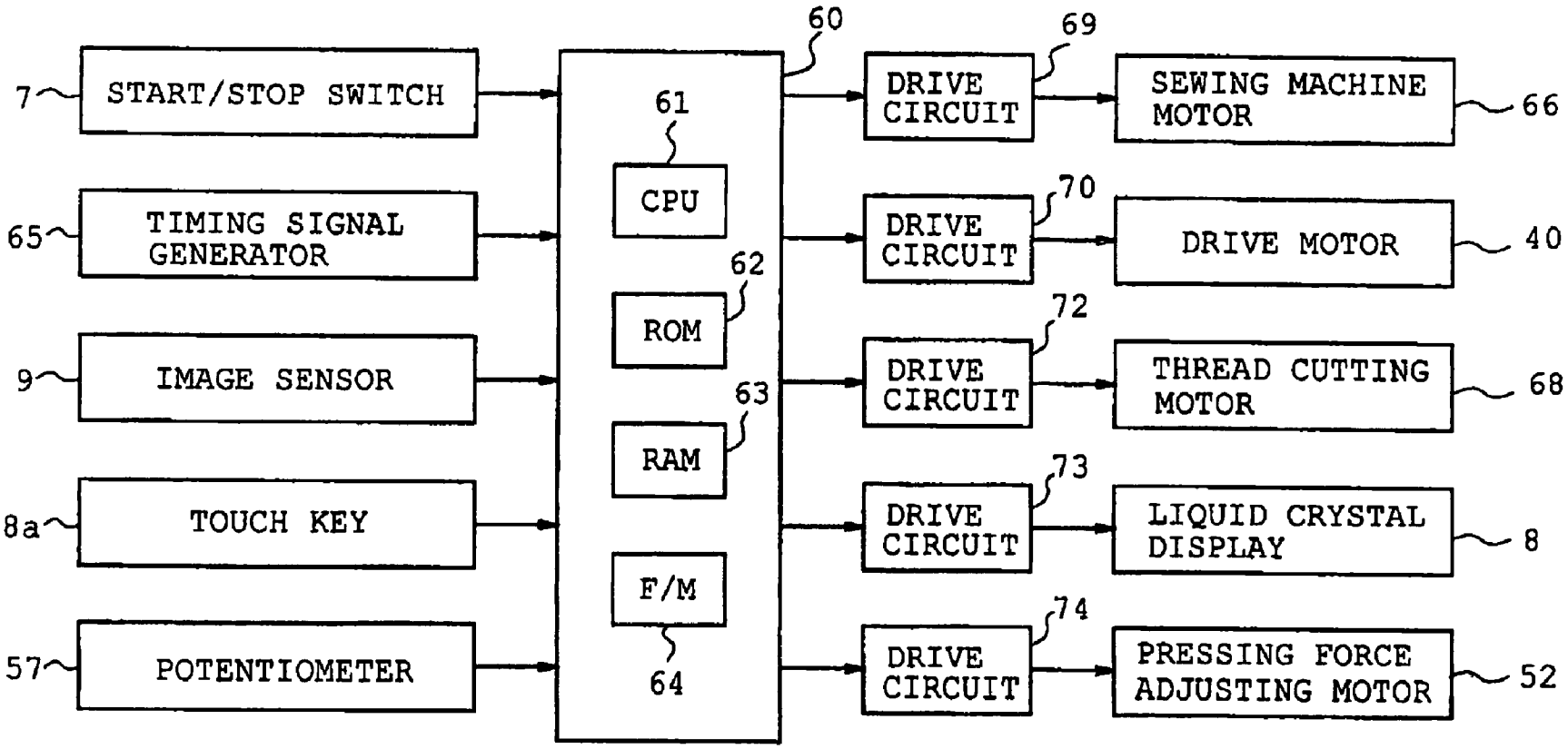
FIG. 11 is a block diagram showing the control system of the lockstitch sewing machine.

On the other hand, a thread take-up crank 19 is secured to a distal end of a main shaft 18 rotated by a sewing machine motor 66 (see FIG. 11). A needlebar crank rod 20 has an upper end rotatably connected to an end of the thread take-up crank 19. A needlebar block 21 is connected to a lower end of the needlebar crank rod 20. The needlebar 5 is constructed so as to be vertically moved via the needlebar block 21 and a connecting mechanism 22.

The connecting mechanism 22 will be described in brief. The needlebar block 21 is slidably supported on the needlebar 5. A fixing member 23 is secured to the needlebar 9, and a vertically directed swinging member 24 has an upper end pivotally mounted on the fixing member 23. The swinging member 24 has a lower end with an engagement convex portion 24*a* which is elastically biased by a coil spring 25 so as to engage an engagement concave portion 21*a* of the needlebar block 21. More specifically, the needlebar 5 is vertically reciprocated via the connecting mechanism 22 when the main shaft 18 is rotated by the sewing machine motor 66 so that the needlebar block 21 is vertically moved via the thread take-up crank 19 and the needlebar crank rod 20.

Next, the following describes a needlebar releasing mechanism 30 for blocking connection between the needlebar 5 and the main shaft 18. A vertically directed pivoting shaft 31 is fixed to a substantially left lower half of the needlebar support 16 as shown in FIGS. 3 and 4. A blocking plate 32 is pivotally mounted on the pivoting shaft 31. The blocking plate 32 includes an operating plate 33 and a driving lever 34 both formed integrally therewith. The operating plate 33 has a size corresponding substantially to a left half of the needlebar support 16 and substantially to a lower half of the needlebar support 16.

The driving lever 34 has a distal end to which the engagement pin 35 is secured so that the engagement pin 35 is capable of abutting against a blocking cam 44*b* of the first cam member 44 from behind. The blocking cam 44*b* will be described in detail later. Furthermore, the blocking plate 32 is biased 25, counterclockwise by the spring force of the coil spring 36 as viewed on a plane. The operating plate 33 is engageable with the engagement protrusion 24*b* of the swinging member 24 from behind. More specifically, the blocking plate 32 is caused to pivot clockwise when the first cam member 44 is rotated clockwise so that the engagement pin 35 is moved rearward by the blocking cam 44*b*. Consequently, the engagement convex portion 24*a* of the swinging member 24 is disengaged from the engagement concave portion 21*a* of the needlebar block 21 via the engagement protrusion 24*b* in engagement with the operating plate 33, whereby the needlebar 5 under vertical drive is blocked off.

As a result, the needlebar 5 is slid to and held at the uppermost position by the spring force of a tension coil spring 38 hooked on a spring-receiving plate 37 mounted to the needlebar support 16. On the other hand, the needlebar block 21 is moved upward when the blocking plate 32 has been returned to a standby position as shown in FIGS. 3 and 4 after blocking of the vertical drive of the needlebar 5. Consequently, the engagement convex portion 24*a* automatically engages the engagement concave portion 21*a* through an inclined guide face 21*b* of the needlebar block 21, whereby the needlebar 5 is re-connected to the main shaft 18 thereby to be vertically driven.

Furthermore, the drive motor 40 comprising a stepping motor is provided on a heightwise middle of the head 4 as shown in FIG. 2. The drive motor 40 includes a drive shaft to which a driving gear 41 is secured. A back-and-forth directed first pivot shaft 42 has a rear end secured to an auxiliary frame 43 below the drive shaft, and the first cam member 44 is supported on the first pivot shaft 42 so as to be pivotable. The first cam member 44 is formed with an eccentric swinging cam 44*a* and the rearwardly protruding blocking cam 44*b*.

Upon application of power to the lockstitch sewing machine M, the drive motor 40 is driven for initialization such that the machine M is set in an initial condition. Subsequently, when a sewing process is carried out in the initial condition, the needlebar 5 is vertically driven, and the drive motor 40 is driven according to a swing width so that the needlebar 5 is swung, whereby stitches are formed on the workpiece cloth W by the needle thread applied with an optimum tension.

When the needlebar 5 is swung within a predetermined swing range as described above, the blocking cam 44*b* of the first cam member 44 and the engagement pin 35 are in such a positional relation that the blocking cam 44*b* does not engage the engagement pin 35. When the drive motor 4 is driven so that the first cam member 44 is rotated to the needlebar release position which exceeds the predetermined swing range, the blocking cam 44*b* engages the engagement pin 35. Accordingly, the engagement pin 35 is moved rearward by the blocking cam 44*b* such the blocking plate 32 is caused to pivot clockwise. As a result, the engagement convex portion 24*a* of the swinging member 24 is disengaged from the engagement concave portion 21*a* of the needlebar block 21, whereupon the needlebar 5 is disconnected from the main shaft 18. Consequently, the needlebar 5 is slid to the uppermost position by the tension coil spring 38 thereby to be held in position.

When the needlebar released state is to be canceled, the drive motor 40 is driven so that the first cam member 44 is returned to an original position. Accordingly, the engagement convex portion 24*a* automatically engages the engagement concave portion 21*a* of the needlebar block 21 assuming the uppermost position, whereby the needlebar 5 is re-connected to the main shaft 18 so as to be vertically driven.

Figure 6:
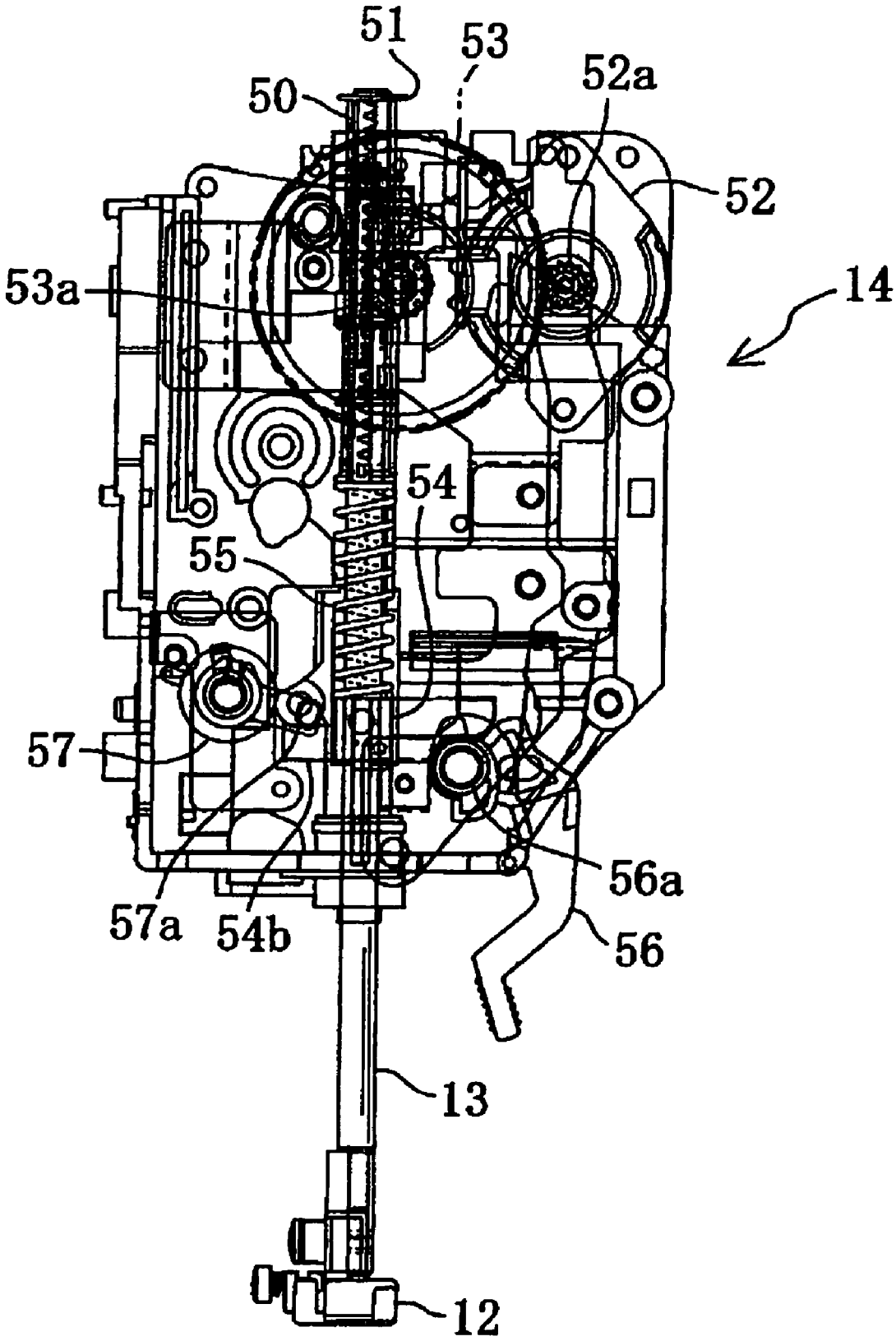
FIG. 6 is a front view of an inner mechanism of the head of the lockstitch sewing machine.

The pressing force adjusting mechanism 14 will now be described with reference to FIG. 6. The pressing force adjusting mechanism 14 moves the presser bar 13 and the presser foot 12 up and down. The presser bar 13 is disposed at the rear of the needlebar 5 and supported on frame F so as to be movable up and down, and the presser foot 12 is attached to the lower end of the presser bar 13. The pressing force adjusting mechanism 14 includes a rack member 50 fitted with the upper end of the presser bar 13 so as to be movable up and down, a retaining ring 51 fixed on the upper end of the presser bar 13 and a driving gear 52*a* coupled to an output shaft of the pressing force adjusting motor 52. The pressing force adjusting mechanism 14 further includes a middle gear 53 brought into mesh engagement with the driving gear 52*a*, a presser bar guide bracket 54 fixed to a heightwise middle of the presser bar 13, a presser spring 55 mounted on a portion of the presser bar 13 located between the rack member 50 and the presser bar guide bracket 54, and the like.

The pressing force adjusting motor 52 is fixed on the frame F so as to be located just on the right of the rack member 50. The middle gear 53 has a pinion 53*a* provided integrally therewith and having a smaller diameter. The pinion 53*a* is in mesh engagement with a rack of the rack member 50. Furthermore, a presser lifting lever 56 is provided near the pressing force adjusting mechanism 14. The presser lifting lever 56 is manually operable to move the presser bar 13 so that the presser bar 13 is allowed to rise and fall. The presser lifting lever 56 is supported so that one end thereof is vertically pivotable on a pivot pin 56*a*. A potentiometer 57 is also provided near the pressing force adjusting mechanism 14 so as to be located just on the left of the presser bar 13.

The potentiometer 57 includes a pivot shaft from which a shaft portion 57*a* extends rightward. The shaft portion 57*a* abuts against an upper surface of the leftwards protruding protrusion 54*b* of the presser bar guide bracket 54. The shaft portion 57*a* is caused to pivot in response to rise or fall of the presser bar 13 and presser bar guide bracket 54 thereby to change a resistance value thereof. The control device 60 which will be described later computes the difference between a resistance value obtained when the workpiece cloth W is located below the presser foot 12 and a resistance value obtained when no workpiece cloth W is located below the presser foot 12, thereby detecting the difference of height of the presser bar 12 or a cloth thickness of the workpiece cloth W.

Figure 7:
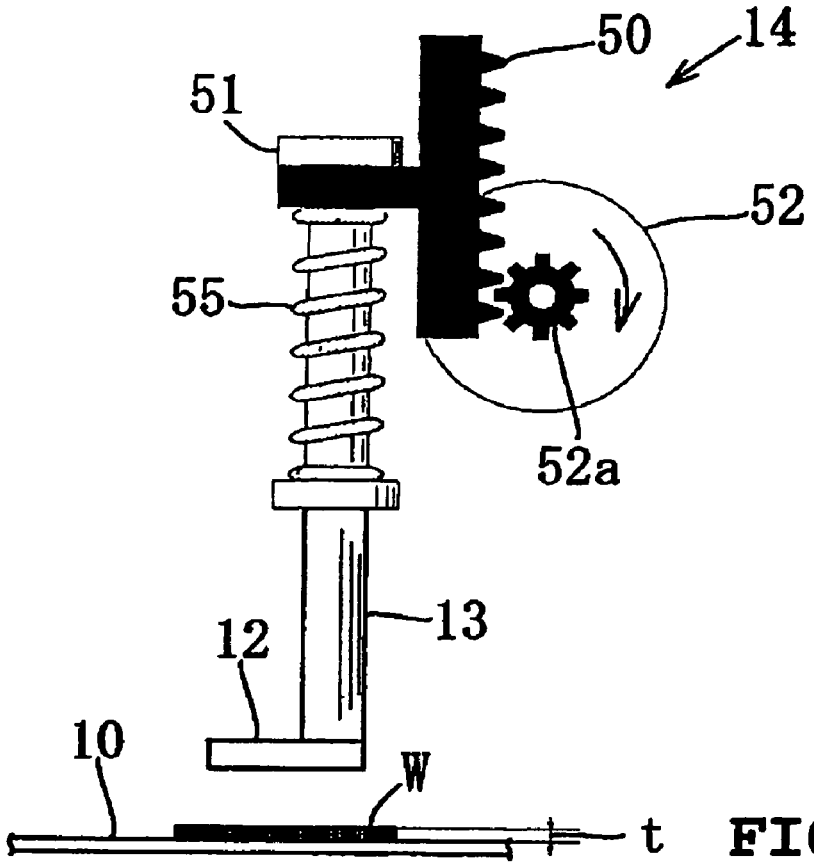
FIG. 7 is a schematic view illustrating a pressing force adjusting mechanism in the case where a presser foot has been moved upward.
Figure 8:
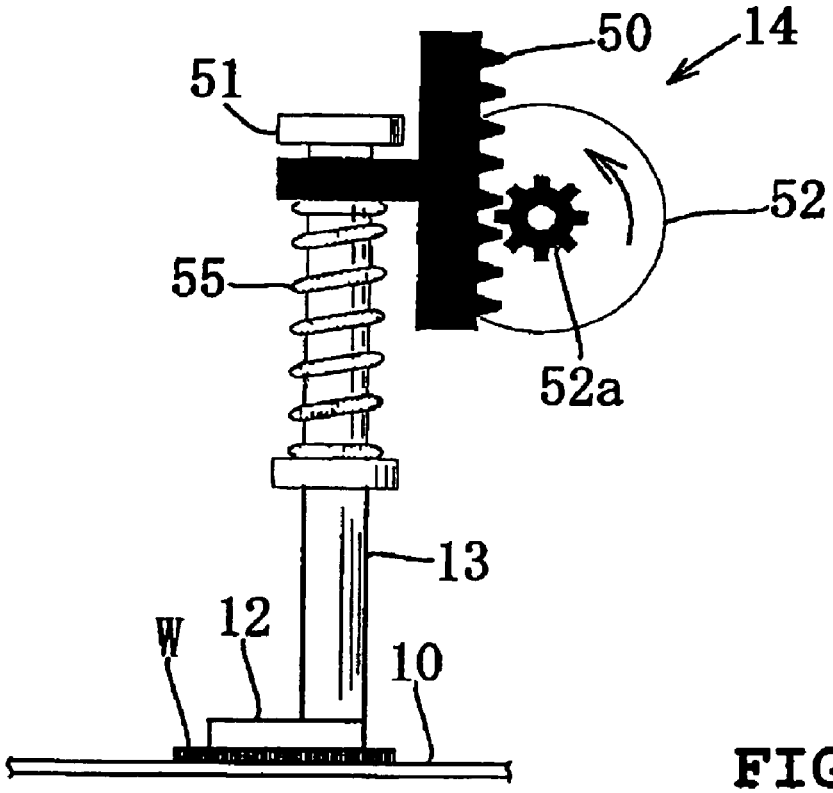
FIG. 8 is a view similar to FIG. 7, showing the case where the pressing force is at 0 [N]

A pressing force adjustment will now be described with reference to FIGS. 7 to 10. The description of the middle gear 53 will be eliminated for the sake of simplification of explanation. The presser foot 12 moves above the needle plate 10 when the rack member 50 moves upward to the predetermined uppermost position while the rack member 50 is in engagement with the retaining ring 51 as the result of the clockwise rotation of the pressing force adjusting motor 52, as shown in FIG. 7. In this case, the operator can place the workpiece cloth W to be sewn on the upper side of the needle plate 10. However, as shown in FIG. 8, when the rack member 50 is moved downward as the result of the counterclockwise rotation of the pressing force adjusting motor 52, the presser foot 12 comes into contact with the surface of the workpiece cloth W over the needle plate 10. However, when the presser spring 55 is not compressed and retains a free length thereof, a pressing force P of the workpiece cloth W by the pressing force adjusting mechanism 14 is at 0 [N].

However, the height of the presser foot 12 in contact with the surface of the workpiece cloth W changes depending upon the cloth thickness t of the workpiece cloth W. Accordingly, the number of steps of the pressing force adjusting motor 52 (a heightwise position of the rack member 50) is suitably changed in proportion to an increase of cloth thickness t based on step number A in the case of cloth thickness t=0. More specifically, the heightwise position of the rack member 50 is adapted to change according to cloth thickness t detected by the potentiometer 57. For example, the number of steps in the case of cloth thickness t=1 mm is set at "A-b" and the heightwise position of the rack member 50 is rendered higher by 1 mm. In other words, even when cloth thickness t of the workpiece cloth W takes any value, the operator can freely move the workpiece cloth W without receiving any movement resistance in the case where the pressing force P is at 0 [N], whereupon a free-motion sewing can be realized. In this case, it is assumed that the weight of the presser bar 13, presser foot 12 and the like has substantially no influence upon the movement of the workpiece cloth W.

Figure 9:
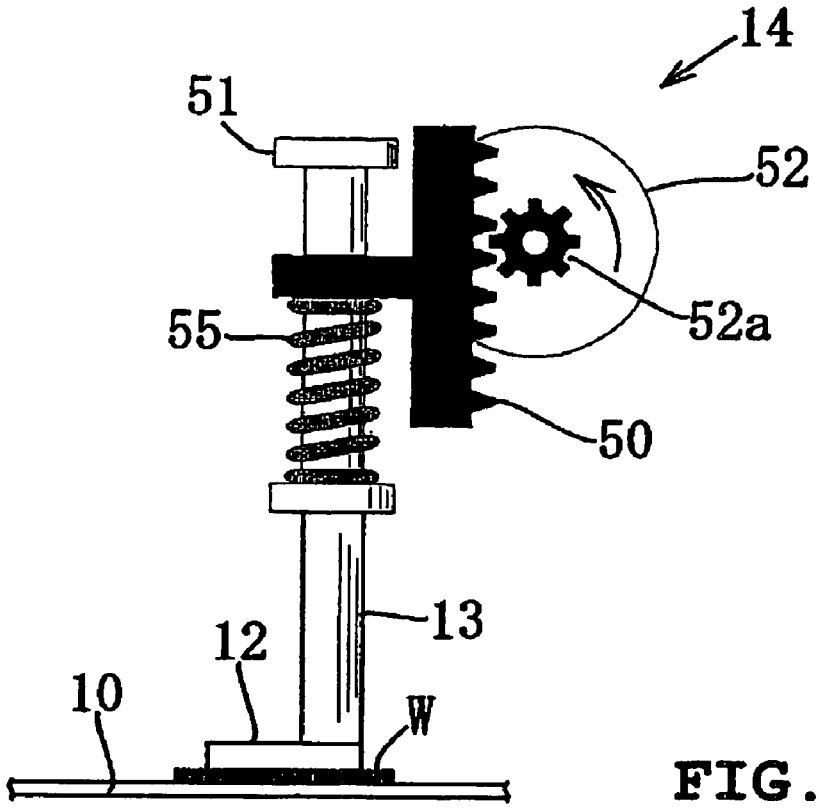
FIG. 9 is a view similar to FIG. 7, showing the case where the pressing force is at work.

However, as shown in FIG. 9, when the pressing force adjusting motor 52 is caused to pivot further counterclockwise, the heightwise position of the rack member 50 is lowered such that the pressing force P pressing the workpiece cloth W is gradually increased from 0 [N] according to a degree to which the rack member 50 is lowered. That is, the pressing force P produced by the presser spring 55 changes in the range from 0 [N] to 20 [N] according to the number of driving steps to rotate the pressing force adjusting motor 52 counterclockwise. In this case, when the workpiece cloth W is manually moved, the movement resistance is rendered larger as the pressing force P is increased, whereupon it becomes harder to manually move the workpiece cloth W. However, when the free-motion sewing which will be described later is to be carried out, the pressing force P changes in the range from 0[N] to 5 [N].

Figure 10:
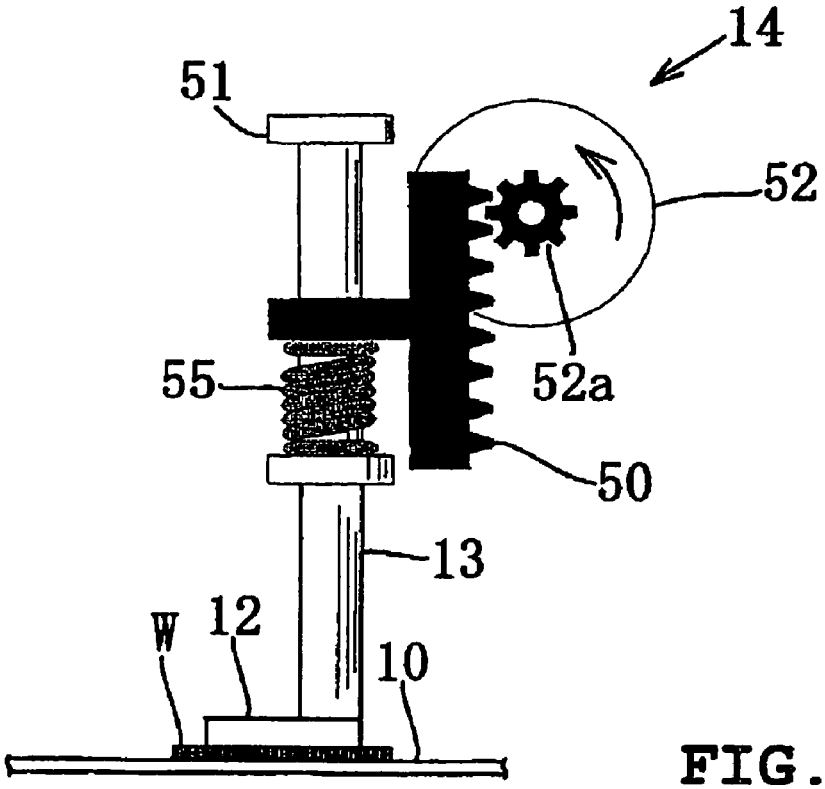
FIG. 10 is a view similar to FIG. 7, showing the case where the pressing force is fully at work.

The height position of the rack member 50 becomes lowest when the counterclockwise rotation of the pressing force adjusting motor 52 is maximized during sewing as shown in FIG. 10, whereupon the pressing force P produced by the presser spring 55 is maximized to 20 [N]. The operator can no longer move the workpiece cloth W even when the pressing force P in the free-motion sewing is at the maximum of 5 [N].

The control system of the lockstitch sewing machine M will be described. Referring to FIG. 11, the control device 60 comprises a computer including a CPU 61, a ROM 62, a RAM 63 and an electrically rewritable non-volatile flash memory (F/M) 64. To the control device 60 are connected the start/stop switch 7, a timing signal generator 65 detecting a rotational position of the main shaft 18, an image sensor 9, a touch key 8*a* and the potentiometer 57. A drive circuit 69 for the sewing machine motor 66 is also connected to the control device 60. A drive circuit 70 for the drive motor 40 is further connected to the control device 60. A drive circuit 72 for a thread cutting motor 68 driving a thread cutting mechanism is further connected to the control device 60. A display drive circuit 73 for the liquid crystal display 8 is further connected to the control device 60. A drive circuit 74 for the pressing force adjusting motor 52 is still further connected to the control device 60.

The ROM 62 stores a control program for cloth movement limiting control and the like in addition to a sewing control program on which various ordinary patterns and embroidery patterns are sewn and a general control program for display control. The RAM 63 is provided with memories necessary in execution of various control manners (memories such as flags, pointers, counters and the like, registers, buffers and the like) if needed.

The ROM 62 also stores a step number table in which the pressing force P [N] and the reference number of driving steps in the case of cloth thickness t=0 mm are interrelated, as shown in FIG. 12. The step number table defines the number of steps in which the pressing force adjusting motor 52 is driven (A, A+α, A+2α, . . . ) when the pressing force P [N] is changed to any magnitude (for example, 0, 0.5, 1.0, 1.5 . . . ) in the case of cloth thickness t=0 mm. In this case, α designates a constant increasing the pressing force P [N] by 0.5. The ROM 62 further stores a cloth thickness table as shown in FIG. 13. The cloth thickness table defines the reference number of drive steps (A, A−b, A−2b, . . . ) when the cloth thickness t is changed from "0 mm" to "1 mm," "2 mm," "3 mm" and so on, for example. Symbol "b" designates a constant for raising the rack member 50 every 1 mm.

The ROM 62 still further stores a pressing force change table as shown in FIG. 14. The pressing force change table defines a changed pressing force ΔP for increasing or decreasing the pressing force P according to a movement amount difference (ΔD mm) obtained by subtracting set stitch pitch PD from an amount of movement of the workpiece cloth W by the manual operation of the operator. For example, when the movement amount difference ΔD is "+1.8 mm," the changed pressing force ΔP is "+1.5." Accordingly, "+3α" is obtained from the step number table as shown in FIG. 12. The pressing force adjusting motor 52 is driven counterclockwise by the number of steps corresponding to "+3α," so that the rack member 50 is further lowered. Accordingly, in this case, the operator becomes hard to move the workpiece cloth W such that the moving speed is reduced.

Figure 15:
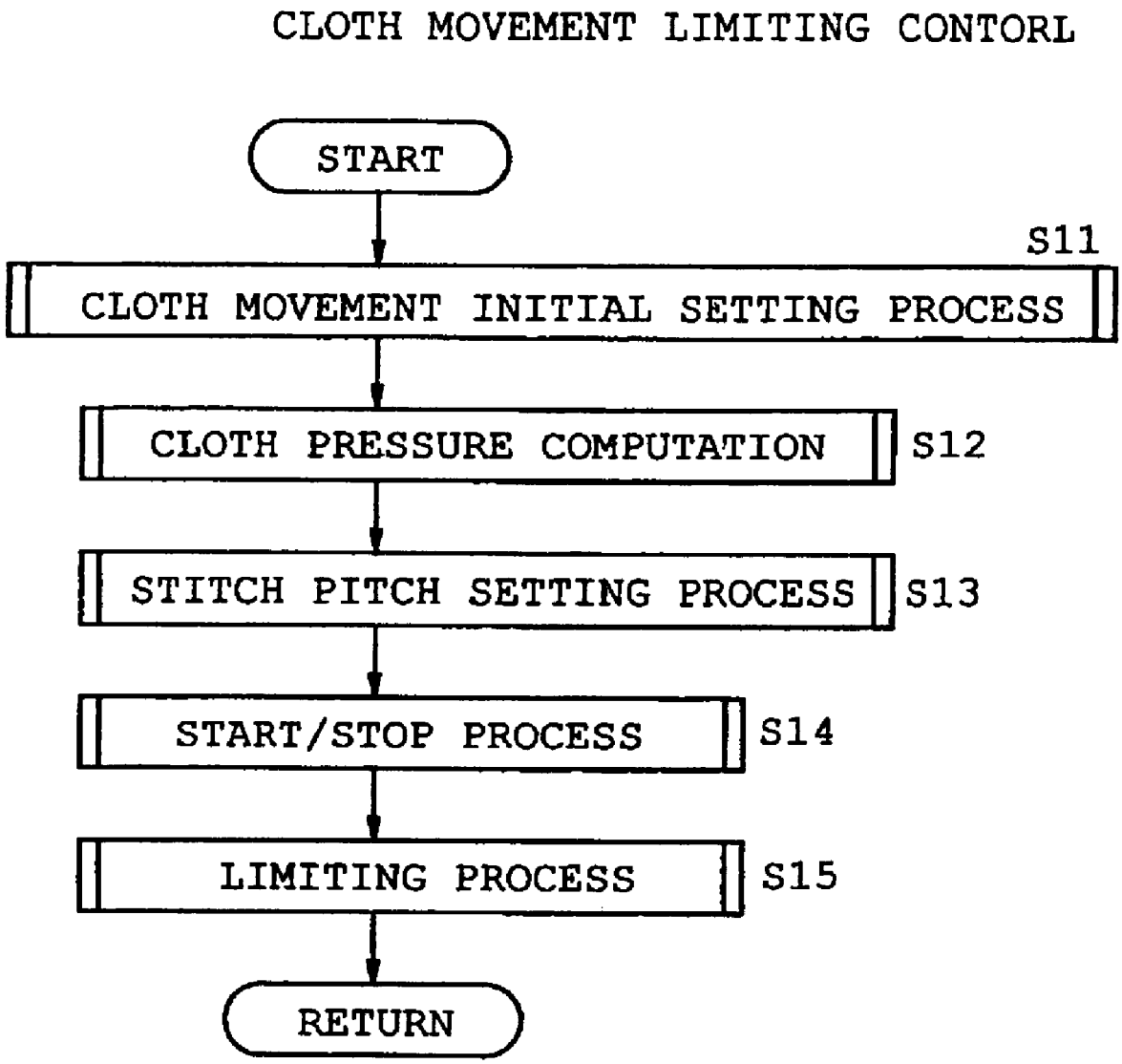
FIG. 15 is a flowchart showing cloth movement limiting control.
Figure 16:
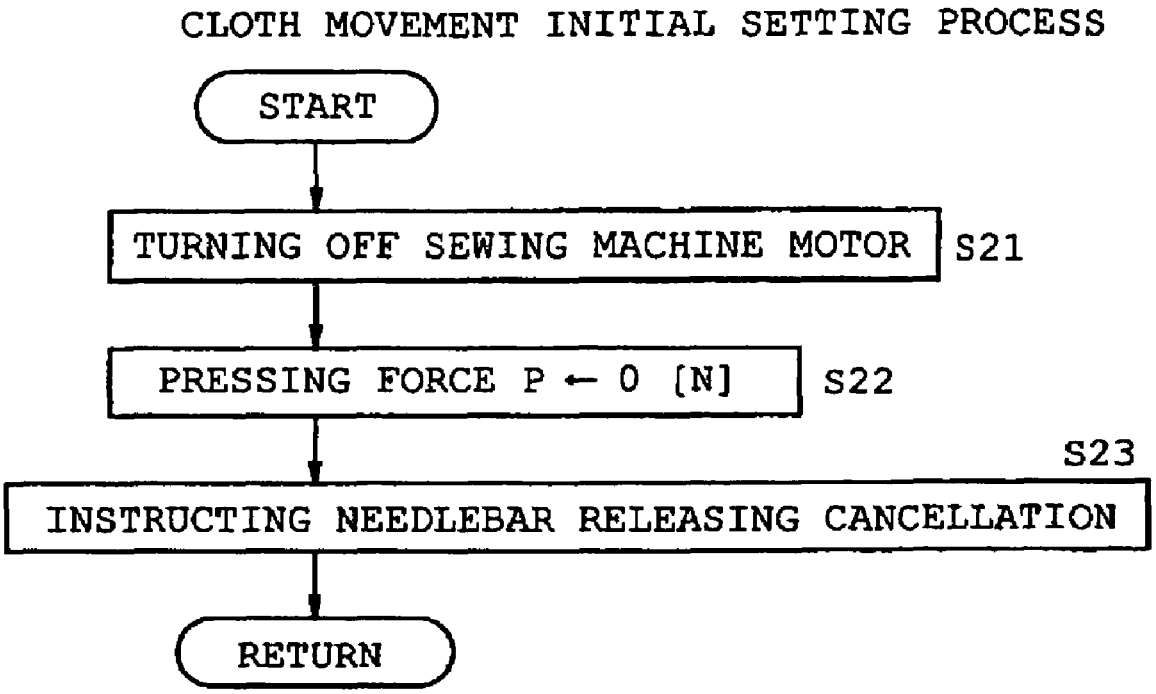
FIG. 16 is a flowchart showing cloth movement initial setting control.
Figure 17:
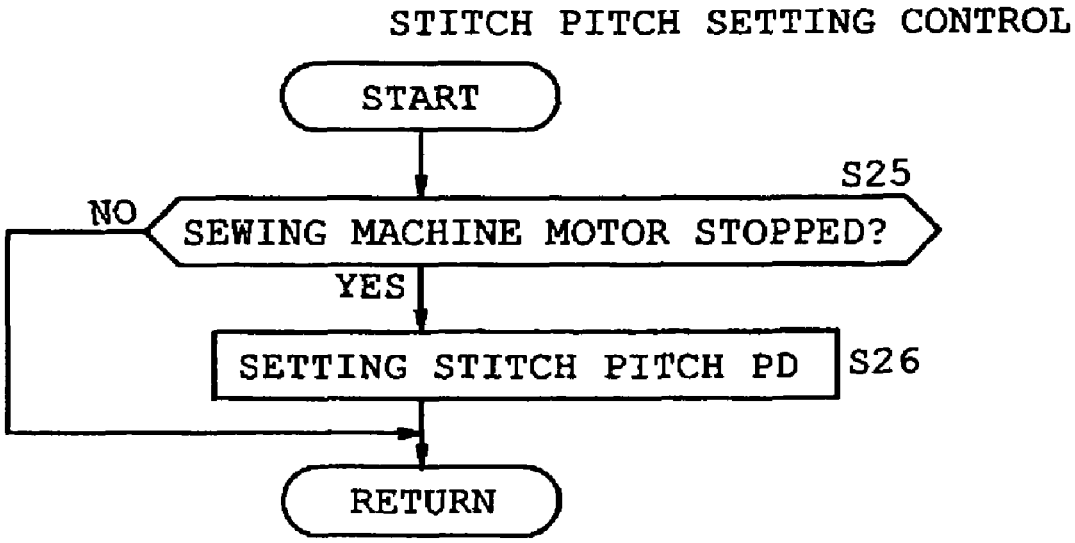
FIG. 17 is a flowchart showing stitch pitch setting control.
Figure 18:
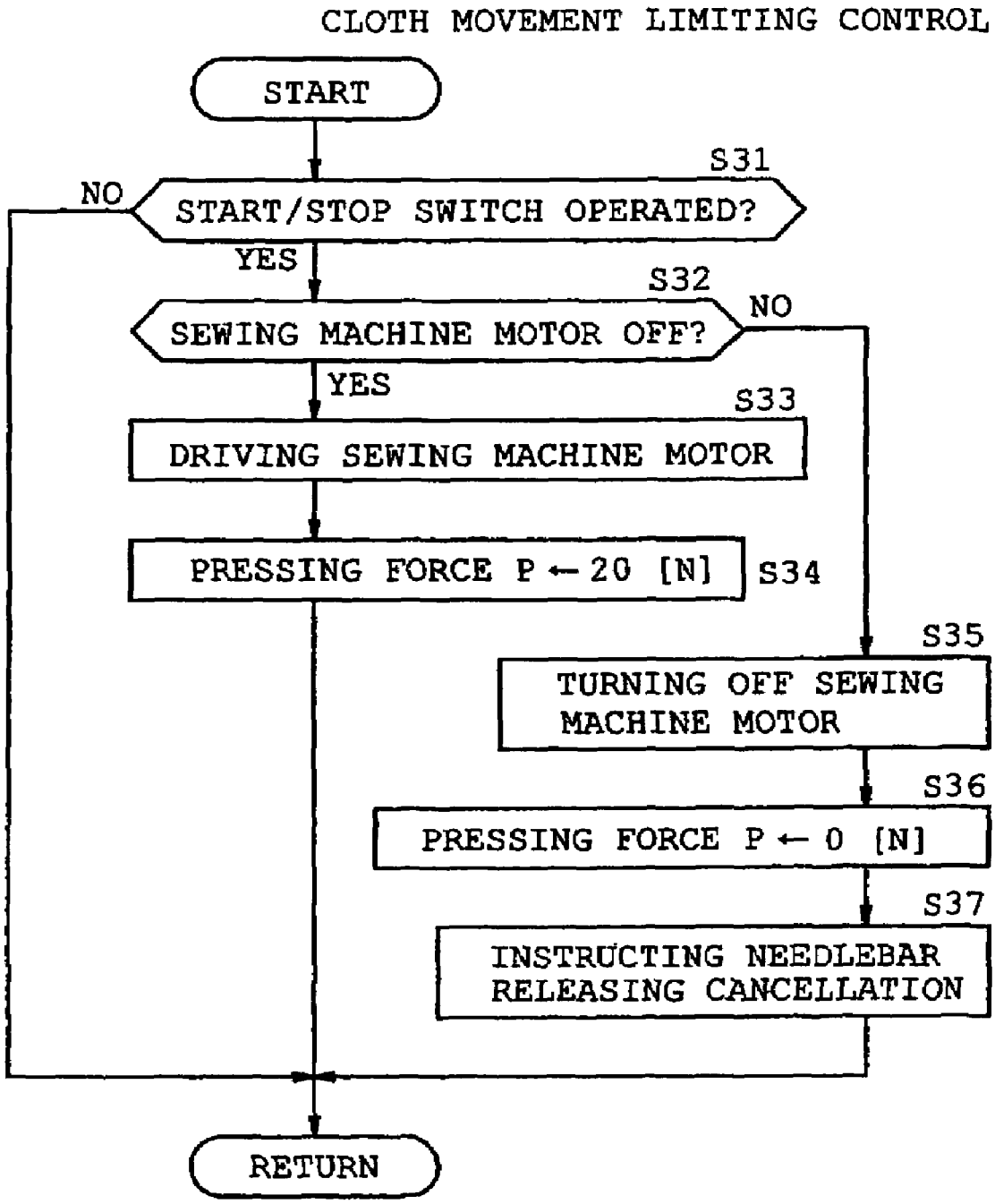
FIG. 18 is a flowchart showing start/stop control.
Figure 19A:
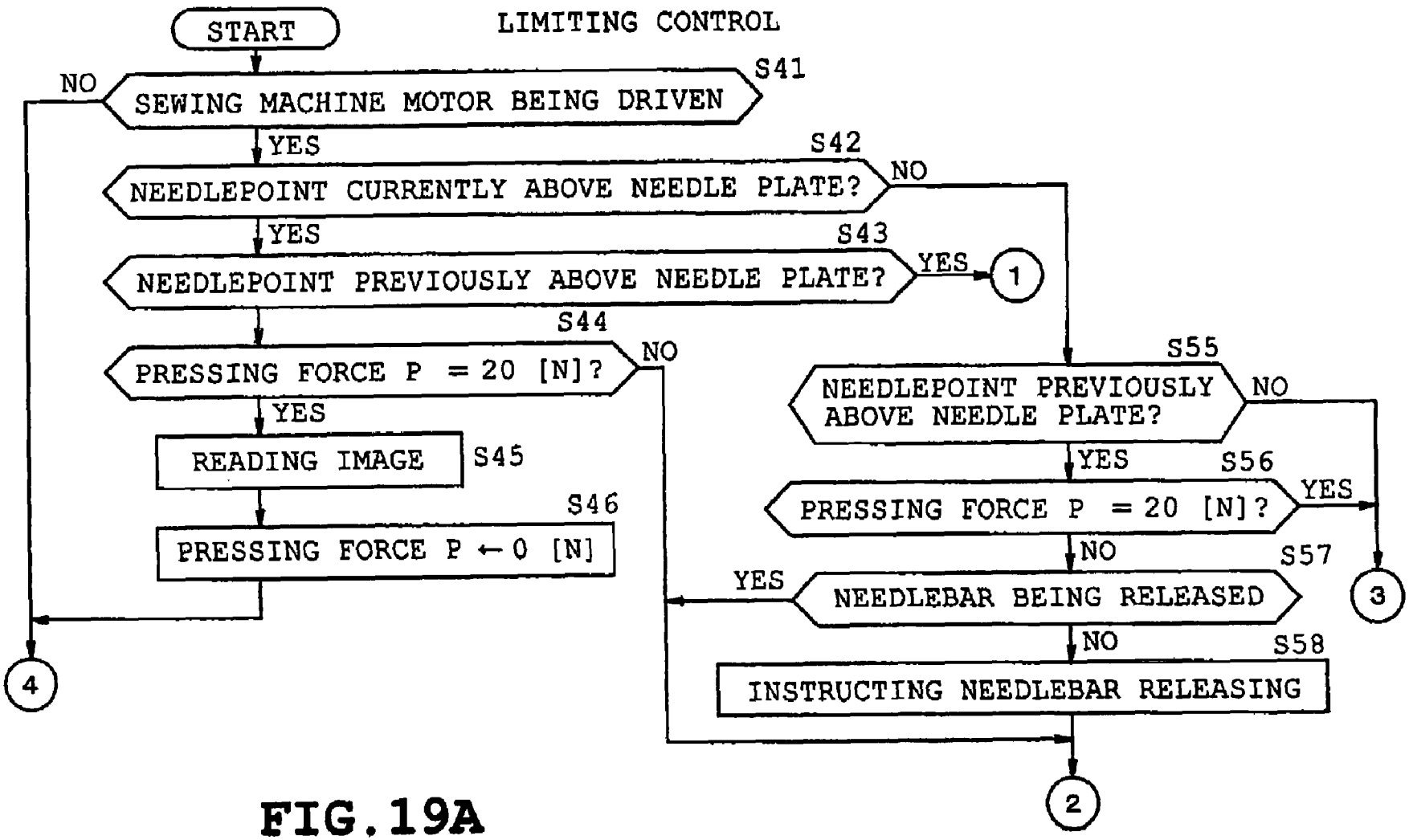
FIGS. 19A and 19B are flowcharts of limiting control.
Figure 19B:
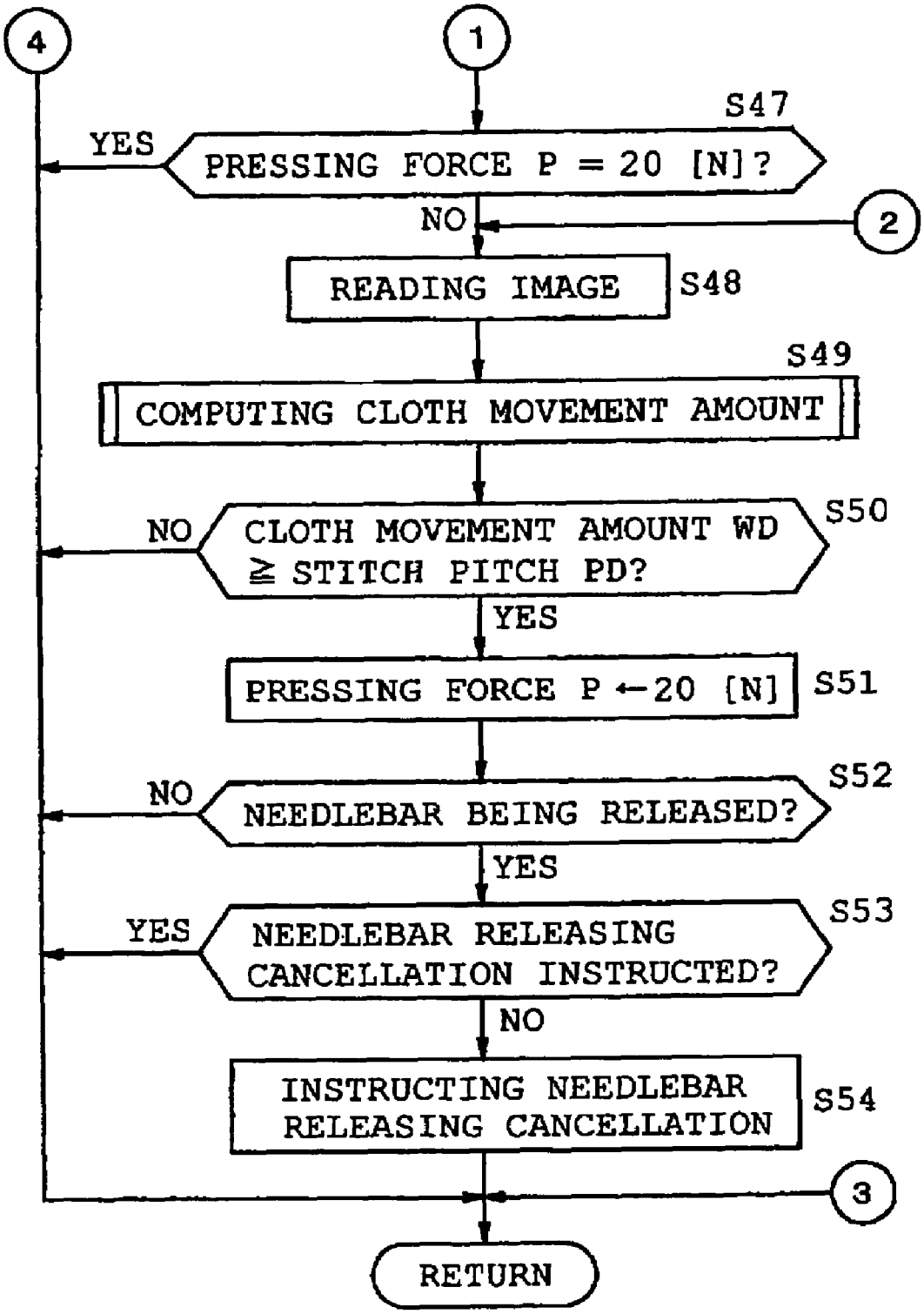

The cloth movement limiting control carried out by the control device 60 of the lockstitch sewing machine M will be described with reference to the flowchart of FIG. 15. In FIG. 15, symbol Si where i=11, 12, 13 . . . designates each step. When a free motion mode is set by the touch key 8*a* of the display 8 in starting the free-motion sewing, the cloth movement limiting control is initiated. Firstly, a cloth movement initial setting process (see FIG. 16) is carried out (S11). When a cloth movement initial setting control for the cloth movement initial setting process is initiated, the sewing machine motor 66 is stopped when being driven (S21). The pressing force P is set at 0 [N] by the pressing force adjusting mechanism (S22) and a release canceling instruction is delivered (S23). Thereafter, the control device 60 terminates the control and returns to the cloth movement limiting control. Accordingly, when the needlebar releasing mechanism 30 assumes a needlebar released state, the drive motor 40 is driven so that the first cam member 44 is returned to the original needlebar connection position, whereby the needlebar 5 is connected to the main shaft 18, as described above.

A cloth thickness computing control for cloth thickness computing process is carried out in the cloth movement limiting control (S12). In the cloth thickness computing control, since the workpiece cloth W to be sewn is placed on the needle plate 10, the pressing force adjusting motor 52 is driven so that the pressing bar 13 is once lowered on the workpiece cloth W. In this case, a resistance value delivered from the potentiometer 57 is read, and the cloth thickness t of the workpiece cloth W is obtained from the resistance value.

Subsequently, a stitch pitch setting control (see FIG. 17) for a stitch pitch setting process is carried out (S13). Upon start of the control, when the sewing machine motor 66 is being driven (S25: No), the control immediately terminates. However, only when the sewing machine motor 66 is at a stop (S25: Yes), stitch pitch setting is carried out (S26). Since a stitch pitch setting screen is displayed on the liquid crystal display 8 in the stitch pitch setting, the operator operates the touch key 8*a* corresponding to a displayed numeric keypad to set a desired stitch pitch, for example, "2 mm" or "3 mm," the set stitch pitch PD is stored on the memory of the RAM 63.

Subsequently, a start/stop control (see FIG. 18) for a start/stop process is carried out in the cloth movement limiting control (S14). Upon start of the control, when the start/stop switch 7 has not been operated (S31: No), the control immediately terminates. However, in the case where the sewing machine motor 66 is at a stop (S32: Yes) when the start/stop switch 7 has been operated (S31: Yes), the sewing machine motor 66 is driven (S33) and the pressing force P is set at 20

[N] (S34). The control device 60 then terminates the control, returning to the cloth movement limiting control.

However, in the case where the sewing machine motor 66 is being driven (S32: No) when the start/stop switch 7 has been operated (S31: Yes), the sewing machine motor 66 is stopped (S35). Subsequently, the pressing force P is changed to 0 [N] so that the workpiece cloth W can be taken out (S36). The needlebar release canceling instruction is delivered (S37) and the control device 60 then terminates the control, returning to the cloth movement limiting control.

Subsequently, a limiting control (see FIGS. 19A and 19B) for a limiting process limiting a movement amount of the workpiece cloth W is carried out (S15). Upon start of the control, when the sewing machine motor 66 is being driven (S41: Yes) and the needlepoint of sewing needle 6 has been moved above the needle plate 10 (S42: Yes), the control device 60 advances to S43. The control device 60 advances to S44 when the needlepoint was previously located below the needle plate 10, that is, when sewing needle 6 has been moved from below the needle plate 10 above the needle plate 10 (S43: No) and the pressing force P is at 20 [N] and the workpiece cloth W is pressed by the pressing force adjusting mechanism 14 so as to be immovable (S44: Yes). At S44, a part of the workpiece cloth W near to the sewing needle 6 is imaged by the image sensor 9. The imaged image data is read to be stored on a predetermined memory of the RAM 63 (S45).

Subsequently, the pressing force P is switched to 0 [N] (S46) and the control terminates. The cloth movement limiting control is carried out at the next time when the control device 60 has determined in the affirmative (Yes) at S42 and S43. When the pressing force P is not set at 20 [N] (S47: No), obtained image data is stored (S48) in the same manner as in S45. Subsequently, a movement amount of the workpiece cloth W is computed based on the image data in S45 and image data produced in S48 (S49).

In the movement amount computing process, image data obtained at the first and second times are compared and computation is carried out so that a movement amount of the workpiece cloth W is obtained. The obtained movement amount is sequentially integrated and stored. Subsequently, the obtained cloth movement amount WD is compared with the size of stitch pitch PD. When the cloth movement amount WD is smaller than the stitch pitch PD (S50: No), S41 to S50 are repeatedly carried out so that the workpiece cloth W is freely moved by the operator.

On the other hand, when the cloth movement amount WD is equal to or larger than the stitch pitch PD (S50: Yes), the pressing force P is set at 20 [N] (S51). As a result, since such a large pressing force as 20 [N] is applied to the workpiece cloth W, the operator can no longer move the workpiece cloth W. When the needlebar is not being released (S52: No), the control device 60 terminates the movement amount computation process, returning to the cloth movement limiting control.

However, cancel of the needlebar release is instructed (S54) when the needlebar is being released (S52: Yes) and the needlebar release canceling instruction has not been delivered (S53: No). The control then terminates. Upon start of the control, the needlepoint of the sewing needle 6 is currently located in the space below the needle plate 10 (S42: No) and was previously located in the space above the needle plate 10. That is, the control device 60 advances to S56 when the sewing needle 6 has been moved from the upper space to the lower space relative to the needle plate 10 (S55: Yes). The control terminates when the pressing force P is at 20 [N] in S56 and the workpiece cloth W has been moved by a distance corresponding to the stitch pitch PD (S56: Yes).

On the other hand, when the pressing force P is not at 20 [N], that is, when the workpiece cloth W has not been moved by the distance corresponding to the stitch pitch PD ((S56: No), the control device 60 advances to S57. When the needlebar 5 is not being released (S57: No), instruction is delivered to release the needlebar releasing mechanism 30 (S58). S48 and subsequent steps are repeatedly carried out. The control device 60 determines in the affirmative in S57 when the cloth movement limiting control is carried out next time and at subsequent times. Accordingly, S51 to S54 are carried out when the cloth movement amount WD is equal to or larger than the stitch pitch PD (S50: Yes) as the result of movement amount computation at S49 based on the image data obtained at S48. The control then terminates.

Figure 20:
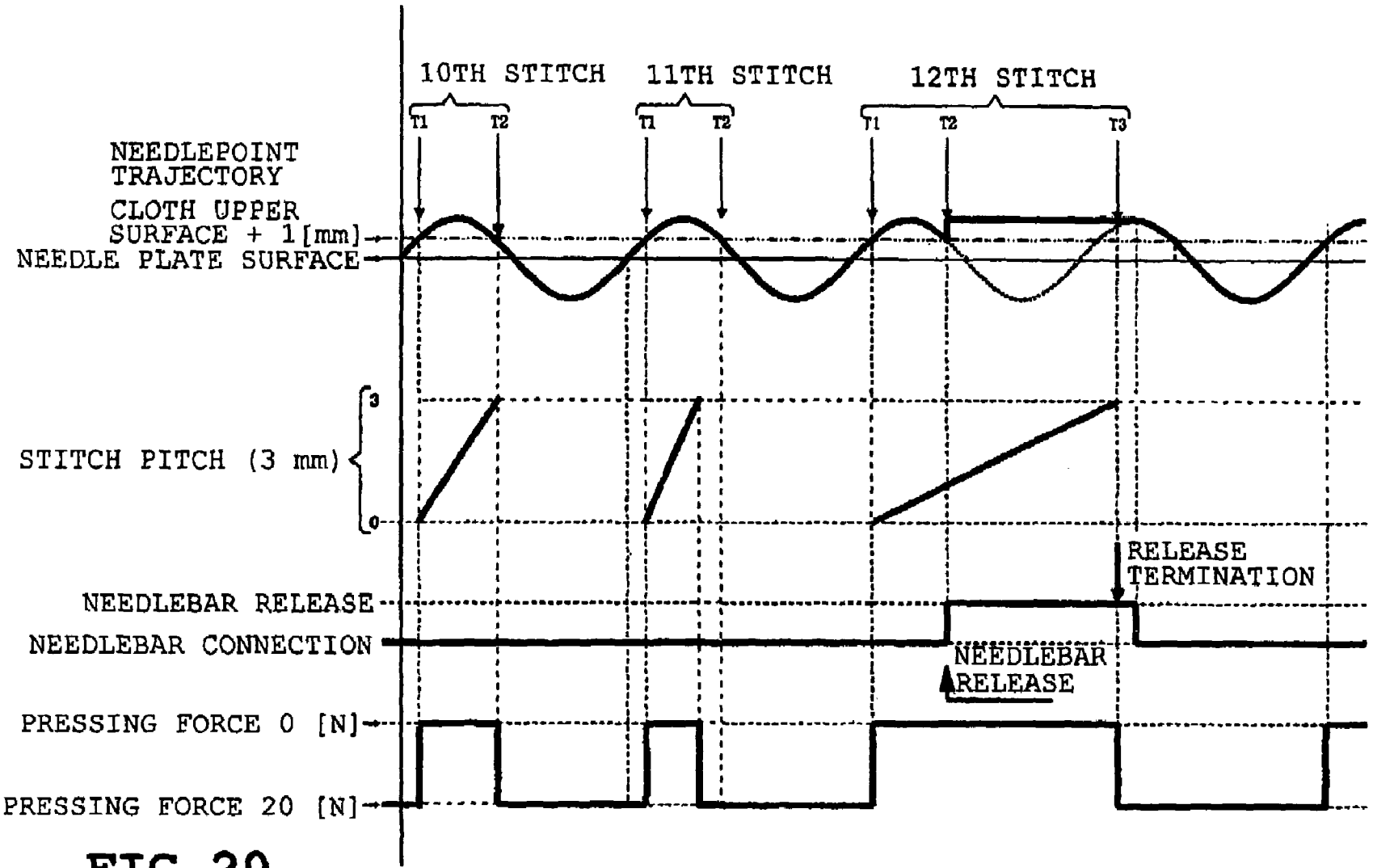
FIG. 20 is a time chart showing vertical movement of the needlebar, movement amount of workpiece cloth, pressing force and needlebar release.

Next, the operation of the cloth movement limiting control thus configured will now be described. In this case, the stitch pitch PD is set at "3 mm" and the cloth thickness t is set at "1 mm." The pressing force P is changed from 20 [N] to 0 [N] at cloth movement start time T1 when the needlepoint of the sewing needle 6 has been moved about 1 mm above the needle plate 10, for example at a tenth stitch, as shown in FIG. 20. Accordingly, the operator carries out free-motion sewing while moving the workpiece cloth W freely. In this case, when the cloth movement amount is at "about 3 mm", which is substantially the same as the stitch pitch PD the pressing force P is changed from 0 [N] to 20 [N] at time T2, whereupon the operator can no longer move the workpiece cloth W. Since the operator moves the workpiece cloth W quickly for the next eleventh stitch, the cloth movement amount becomes "about 3 mm" which is substantially the same as the stitch pitch PD until the cloth movement termination time T2 is reached. At this time, the pressing force P is changed from 0 [N] to 20 [N].

When the operator moves the workpiece cloth W slowly for a twelfth stitch, the cloth movement amount does not reach the stitch pitch PD after the cloth movement termination time T2 has passed. In this case, the needlebar release is carried out at time T2. Thus, the operator can move the workpiece cloth in the needlebar released state continuously until the cloth movement amount reaches the stitch pitch PD. When, at time T3, the cloth movement amount becomes "about 3 mm" which is substantially the same as the stitch pitch PD, the pressing force P is changed from 0 [N] to 20 [N] at time T3 and the needlebar release is cancelled.

Thus, the movement amount of the workpiece cloth W manually moved by the operator is computed for every sewing cycle without change in the rotational speed of the sewing machine motor 66, based on the image data obtained by the image sensor 9. The pressing force adjusting motor 52 is controlled according to the result of comparison in which the movement amount is compared with the stitch pitch PD. Accordingly, the movement amount of the workpiece cloth W can be limited substantially to the stitch pitch PD by the pressing force adjusting mechanism 14. Consequently, even a beginner who is unfamiliar with a sewing work can carry out free-motion sewing such as quilting without any anxiety while enjoying sewing.

Figure 21:
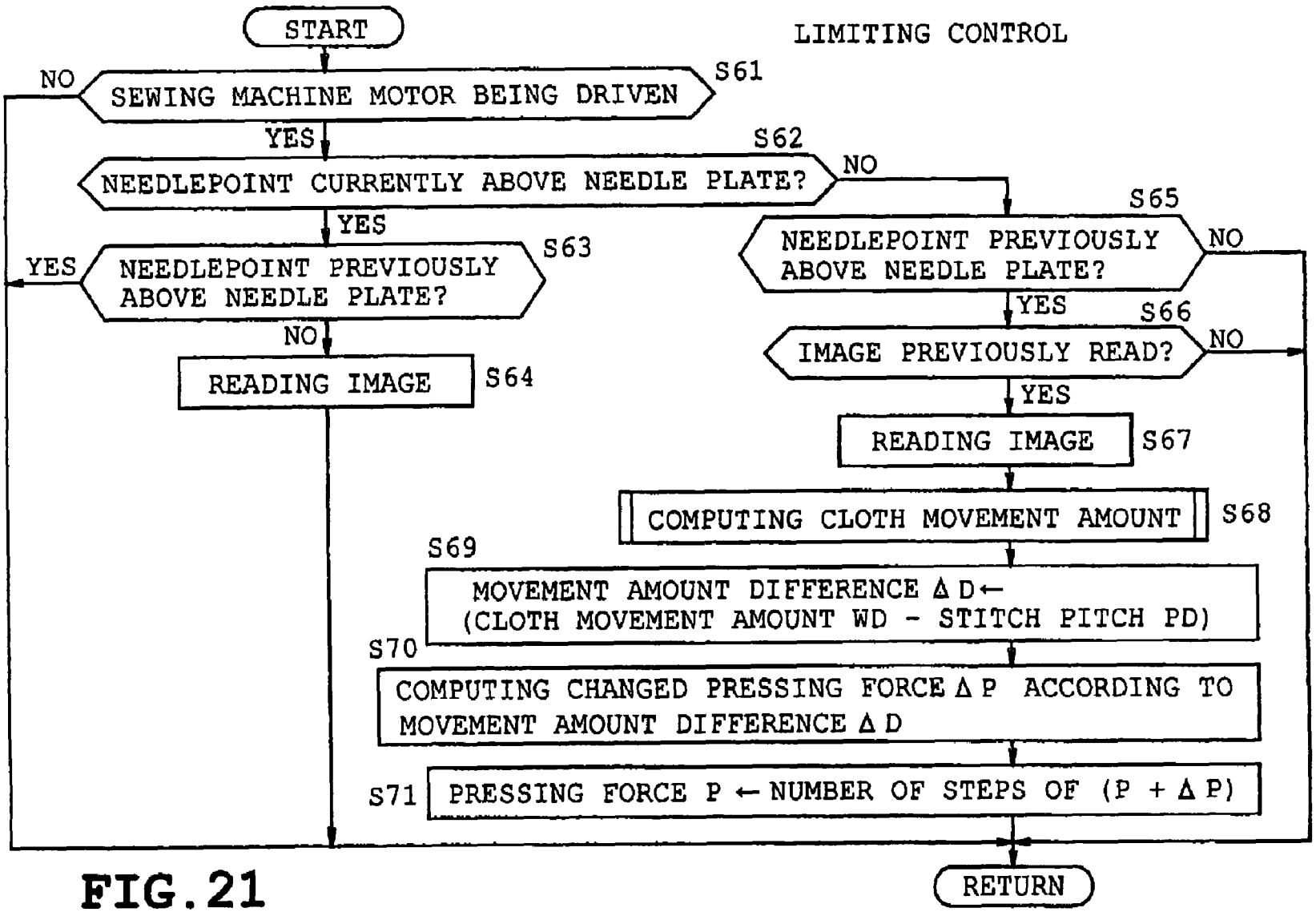
FIG. 21 is a view similar to FIGS. 19A and 19B, showing a second illustrative example.
Figure 22:
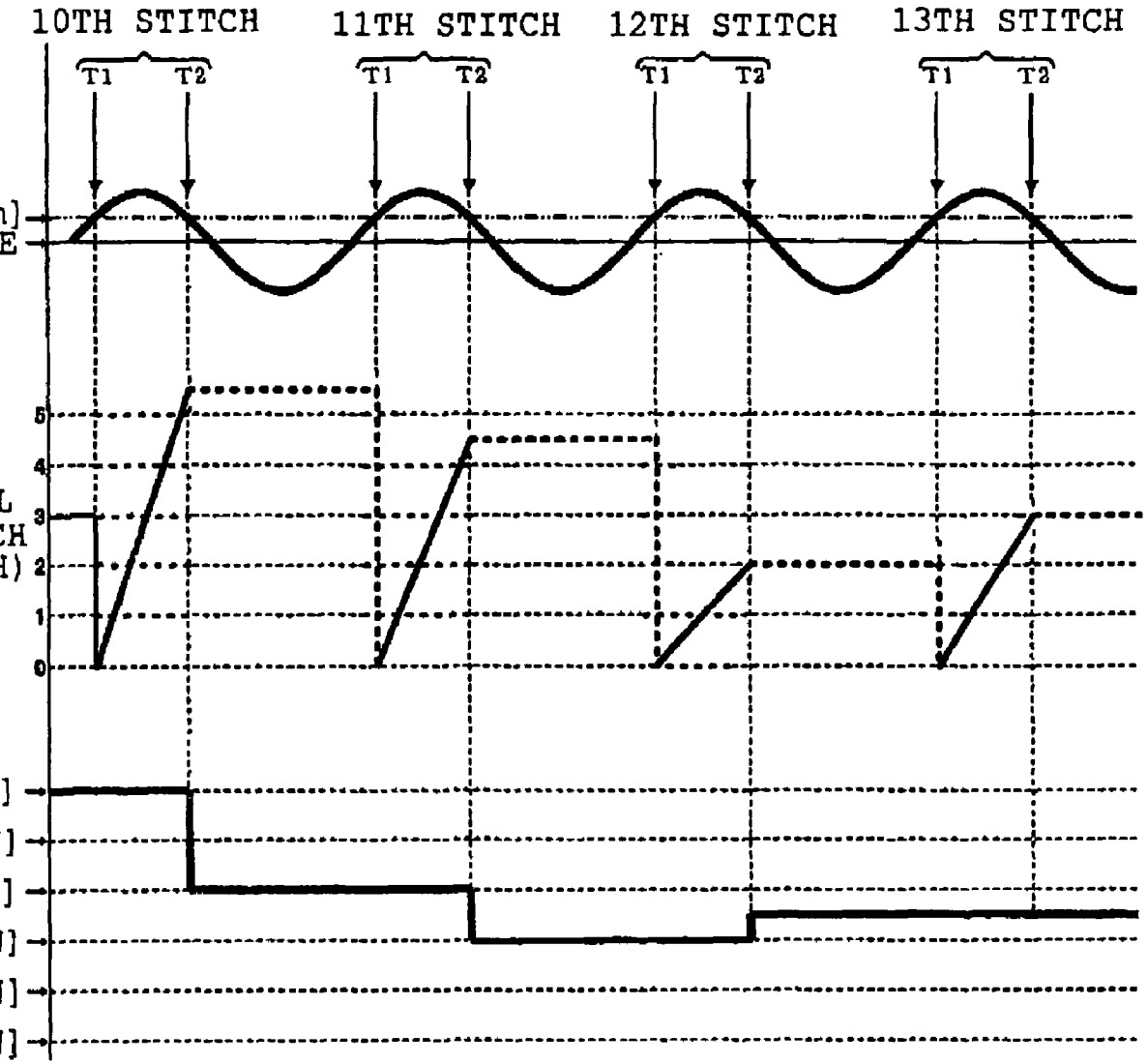
FIG. 22 is a time chart showing vertical movement of the needlebar, movement amount of workpiece cloth, pressing force and needlebar release in the second illustrative example.

FIGS. 21 and 22 illustrate a second embodiment in which the above-described first embodiment is partially modified. In the second embodiment, the limiting control manner is partially modified as shown in FIG. 21. More specifically, when the movement amount of the workpiece cloth W is larger than the stitch pitch PD, the pressing force P is controlled so as to be increased so that the moving speed of the workpiece cloth W is reduced. Furthermore, when the movement amount of the workpiece cloth W is smaller than the stitch pitch PD, the pressing force P is controlled so as to be reduced so that the movement speed of the workpiece cloth W is increased.

The sewing machine motor 66 is being driven (S61: Yes) when the limiting control starts. The needlepoint of the sewing needle 6 is currently located above the needle plate 10 and was previously located below the needle plate 10. That is, the control device 60 advances to S64 when the sewing needle 6 has been moved from the lower space to the upper space relative to the needle plate 10 (S63: No). In S64, a part of the workpiece cloth W near to the sewing needle 6 is imaged by the image sensor 9. Obtained image data is read to be stored on the predetermined memory of the RAM 63 (S64) and the control then terminates.

The control device 60 determines in the affirmative in S62 and S63 when the limiting control is carried out next time. The control then terminates. After this is repeated some times, the needlepoint of the sewing needle 6 is moved below the needle plate 10. The control device 60 then determines in the negative (No) in S62 and in the affirmative (Yes) in S65. Furthermore, when the image has been read in S64 (S66: Yes), the control device 60 advances to S67, where the obtained image data is read and stored in the same manner as in S64. Subsequently, a movement amount of the workpiece cloth W is computed based on the image data obtained in S64 and the image data read in S67 (S68).

Subsequently, based on the obtained cloth movement amount WD and stitch pitch PD, a movement amount difference ΔD obtained by subtracting the stitch pitch PD from the cloth movement amount WD is computed (S69). Subsequently, based on a cloth pressing force change table of FIG. 14, changed pressing force ΔP according to the movement amount difference ΔD is computed (S70). Subsequently, new pressing force P applied to the workpiece cloth W is computed (S71) based on the changed pressing force ΔP and changed number of steps (step number of ΔP) obtained from a step number table as shown in FIG. 12.

Next, the operation of the cloth movement limiting control thus configured will now be described. In this case, the stitch pitch PD is set at "3 mm" and the cloth thickness t is set at "1 mm."

The pressing force P is set at 0 [N] at cloth movement start time T1 when the needlepoint of the sewing needle 6 has been moved about 1 mm above the needle plate 10, for example at a tenth stitch, as shown in FIG. 22. Accordingly, the operator carries out free-motion sewing in a period from the cloth movement start time T1 to the cloth movement termination time T2 while moving the workpiece cloth W freely. In this case, when the cloth movement amount is at "about 5.5 mm" which is larger than the stitch pitch PD, the movement amount difference ΔD is at "+2.5 mm." As a result, "+2.0" is obtained as the changed pressing force ΔP based on the pressing force change table of FIG. 14. Furthermore, "+4α" is obtained from the step number table of FIG. 12, and the pressing force adjusting motor 52 is rotated counterclockwise by the number of steps corresponding to "+4α." Accordingly, the pressing force P is set at 2 [N]. Consequently, since the rack member 50 is further moved downward such that the pressing force P is increased, the operator is hard to move the workpiece cloth W, whereupon the moving speed is reduced. As a result, when the cloth movement amount becomes "about 4.5 mm" at the next eleventh stitch, the movement amount difference ΔD is "+1.5 mm" and the changed pressing force ΔP is "+1.5 mm." Accordingly, the pressing force adjusting motor 52 is rotated counterclockwise by the number of steps corresponding to "+3α" and the pressing force P is set at 3 [N].

When the cloth movement amount becomes "about 2 mm" at the next twelfth stitch, the movement amount difference ΔD is "−1 mm" and the changed pressing force ΔP is "−0.5." Accordingly, the pressing force adjusting motor 52 is rotated clockwise by the number of steps corresponding to "−1α" and the pressing force P is set at 2.5 [N]. When the cloth movement amount becomes "about 3 mm" at the next thirteenth stitch, the movement amount difference ΔD is "0" and the changed pressing force ΔP is "0." Accordingly, the pressing force P remains unchanged at 3 [N].

As obvious from the foregoing, a movement amount of the workpiece cloth W to be manually moved by the operator is computed for every sewing cycle without changing the rotational speed of the sewing machine motor 66 based on image data obtained by the image sensor 9. The computed movement amount is compared with the stitch pitch PD. The pressing force adjusting motor 52 is controlled according to the results of comparison. Furthermore, the pressing force P the presser foot 12 applies to the workpiece cloth W is adjusted so that a movement amount of the workpiece cloth W manually moved by the operator becomes substantially equal to the stitch pitch PD. As a result, a movement amount of the workpiece cloth W by the operator can be accurately limited by a simple mechanism.

The pressing force P rendering the workpiece cloth W immovable by the operator should not be limited to 20 [N] in the above-described limiting control as shown in FIG. 19. The pressing force P may be smaller than 20 [N] in this case. Furthermore, a CMOS image sensor or another imaging device may be employed, instead of the above-described CCD image sensor.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine which is capable of executing a free-motion sewing while a feed dog is accommodated in a bed and a workpiece cloth to be sewn is manually moved by an operator, comprising:

a sewing machine motor;

a main shaft driven by the sewing machine motor;

a needlebar having a lower end to which a sewing needle is attached;

a needlebar driving mechanism that vertically drives the needlebar via the main shaft;

a presser foot that presses the workpiece cloth;

an imaging device that images at least an area of the workpiece cloth near to the sewing needle;

a movement amount operating device that obtains by a movement amount of the workpiece cloth based on image data supplied from the imaging device;

a setting device that sets a stitch pitch on the workpiece cloth;

a comparing device that compares the movement amount of the workpiece cloth obtained by the movement amount operating device and the stitch pitch set by the setting device;

a cloth movement limiter that limits a manual operation of the workpiece cloth, the manual operation applying an only external force to increase or decrease the movement amount; and a control device that controls the cloth movement limiter according to a result of comparison by the comparing device.

2. The sewing machine according to claim 1, wherein the cloth movement limiter has a pressing force adjusting mechanism that adjusts a pressing force the presser foot applies to the workpiece cloth and an actuator that drives the pressing force adjusting mechanism.

3. The sewing machine according to claim 2, wherein when the result of comparison by the comparing device indicates that a movement amount of the workpiece cloth is equal to or larger than the stitch pitch, the control device controls the actuator so that the presser foot presses the workpiece cloth by such a pressing force that the workpiece cloth is rendered immovable.

4. The sewing machine according to claim 1, further comprising a needlebar releasing mechanism capable of blocking transmission of a drive force from the main shaft to the needlebar, wherein when the result of comparison by the comparing device indicates that an movement amount of the workpiece cloth is smaller than the stitch pitch, the control device controls the needlebar releasing mechanism so that drive of the needlebar is stopped.

5. The sewing machine according to claim 1, wherein the imaging device comprises a CCD or CMOS image sensor.

6. A computer readable storage medium storing a program on which a sewing machine accomplishes steps, the sewing machine comprising a sewing machine motor, a main shaft driven by the sewing machine motor, a needlebar having a lower end to which a sewing needle is attached, a needlebar driving mechanism that vertically drives the needlebar via the main shaft, a presser foot that presses the workpiece cloth, and a cloth movement limiter that limits movement of the workpiece cloth by the manual operation, the sewing machine being capable of executing a free-motion sewing while a feed dog is accommodated in a bed and a workpiece cloth to be sewn is manually moved by an operator, the steps comprising:

obtaining by operation a movement amount of the workpiece cloth only manually moved by the operator based on image data supplied from an imaging device imaging at least an area of the workpiece cloth near to the sewing needle;

setting a stitch pitch on the workpiece cloth;

comparing the movement amount of the workpiece cloth obtained in the movement amount obtaining step and the stitch pitch set in the setting step; and controlling the cloth movement limiter according to a result of comparison by the comparing step.

7. The storage medium according to claim 6, wherein when the result of comparison in the comparing step indicates that a movement amount of the workpiece cloth is equal to or larger than the stitch pitch, the control step controls an actuator that drives an adjusting mechanism that adjusts a pressing force by which the presser foot presses the workpiece cloth so that the presser foot presses the workpiece cloth by such a pressing force that the workpiece cloth is rendered immovable.

8. The storage medium according to claim 6, wherein the sewing machine comprises a needlebar releasing mechanism capable of blocking transmission of a drive force from the main shaft to the needlebar, and when the result of comparison at the comparing step indicates that a movement amount of the workpiece cloth is smaller than the stitch pitch, the control step controls the needlebar releasing mechanism so that drive of the needlebar is stopped.

* * * * *